US005984448A

United States Patent [19]

Yanagawa

[11] Patent Number: 5,984,448

[45] Date of Patent: Nov. 16, 1999

[54] CIRCUIT FOR DRIVING INK-JET HEAD AND METHOD OF DRIVING THE SAME

[75] Inventor: Yoshihiko Yanagawa, Musashimurayama, Japan

[73] Assignee: Citizen Watch Co., Ltd., Tokyo, Japan

[21] Appl. No.: 08/860,923

[22] PCT Filed: Nov. 21, 1996

[86] PCT No.: PCT/JP96/03417

§ 371 Date: Jul. 17, 1997

§ 102(e) Date: Jul. 17, 1997

[87] PCT Pub. No.: WO97/18953

PCT Pub. Date: May 29, 1997

[30] Foreign Application Priority Data

Nov. 21, 1995 [JP] Japan ..... 7-302623
Jan. 24, 1996 [JP] Japan ..... 8-010080

[51] Int. Cl.[6] ..... B41J 29/38

[52] U.S. Cl. ..... 347/10; 347/15

[58] Field of Search ..... 347/9, 10, 11, 347/15; 358/298

[56] References Cited

U.S. PATENT DOCUMENTS 5,327,166 7/1994 Shimada ..... 347/15 X
5,343,231 8/1994 Suzuki ..... 347/15 X

FOREIGN PATENT DOCUMENTS 145129 6/1985 European Pat. Off. .
62-152761 7/1987 Japan .
8-174868 7/1996 Japan .

*Primary Examiner*—Richard Moses
*Attorney, Agent, or Firm*—Armstrong, Westerman, Hattori, McLeland & Naughton

[57] ABSTRACT

A circuit for driving an ink-jet head comprising a common driving waveform generation circuit 11 for generating a driving voltage signal, an analog/digital converter circuit 12 for converting the driving voltage signal into driving waveform data, a gradation data separation/accumulation circuit 13 for separating printing gradation data contained in printing data therefrom, accumulating therein the separated printing gradation data temporarily, and outputting the separated printing gradation data at a predetermined timing, a comparator circuit 14 for comparing the printing gradation data with the driving waveform data and outputting a comparison signal. The circuit further comprises a printing control circuit 15 for judging presence of an ink discharge instruction signal contained in the printing data and outputting a switch control signal, a switch control circuit 16 for making a logical product by the comparison signal and the switch control signal, and outputting an analog switch control signal, and a bidirectional analog switch for controlling conductivity of the driving voltage signal so as to drive the piezoelectric actuator in accordance with the analog switch control signal. As a result, volume of ink droplets discharged from a nozzle can be controlled to comply with a picture image with density gradation, and free vibrations generated in the piezoelectric actuator are damped to thereby obtain ink droplets with a constant speed regardless of the size of the ink droplets.

16 Claims, 12 Drawing Sheets

CIRCUIT FOR DRIVING INK-JET HEAD AND METHOD OF DRIVING THE SAME

TECHNICAL FIELD

This invention relates to a circuit for driving an ink-jet head using a piezoelectric actuator and a method of driving the same, more particularly to a circuit for driving an ink-jet head to record a gradation of density on a recording medium such as a printing paper and a method of driving the same.

BACKGROUND TECHNOLOGY

An ink-jet printer is known which uses an ink-jet recording system that jets a liquid ink droplet through a nozzle of the ink-jet head onto a recording medium such as a printing paper, thereby recording characters, image and the like on the medium.

The ink-jet printer using the foregoing system has advantages as follows:

(1) the mechanism, construction, and printing process of the system are comparably simple, and no noise is emitted in printing;

(2) being capable of discharging a minimal ink droplet, high resolution printing is possible;

(3) arranging plural color inks facilitates color printing;

(4) the system does not consume much power; and (5) the price is comparably low.

Owing to these advantages, the ink-jet printer using this system has been spreading rapidly as a printer for not only personal computers but also for various office automation apparatus.

Of the ink-jet printer, the so-called drop-on-demand (DOD) type ink-jet printer, which discharges ink droplets only when a printing instruction is issued to minimize the ink consumption, is the most popular.

As major techniques to discharge ink by this DOD type ink-jet printer, there are the piezoelectric system that applies a pressure to the ink chamber by a force induced by the piezoelectric actuator as an electromechanical transducer and the bubble system that utilizes an expansion pressure of bubbles produced by an instantaneous vaporization of ink by an electric heater.

As a conventional example, a circuit for driving an ink-jet head using the piezoelectric actuator and a method of driving the same will be described with reference to FIG. 14 and FIG. 15.

In the circuit for driving an ink-jet head shown in FIG. 14, the emitter of an NPN transistor Q2 and one terminal of a piezoelectric actuator PZ are connected to the ground terminal GND as the earth potential.

A power source voltage VH for the ink-jet head is applied to the emitter of a PNP transistor Q1, one terminal of a second resistor R2, and one terminal of a third resistor R3.

A control signal S for driving the piezoelectric actuator PZ enters input terminals of a first inverter U1 of the open collector type and a second inverter U2. The output of the first inverter U1 is given through a first resistor R1 to the other terminal of the second resistor R2 and the base of the PNP transistor Q1.

The output of the second inverter U2 is given to the other terminal of the third resistor R3 and the base of the NPN transistor Q2. The collector of the NPN transistor Q2 is connected through a fifth resistor R5 to one terminal of a fourth resistor R4 and to the other terminal of the piezoelectric actuator PZ. The other terminal of the fourth resistor R4 is connected to the collector of the PNP transistor Q1.

The foregoing driving circuit drives the ink-jet head as follows.

Applying a pulse waveform voltage to the piezoelectric actuator PZ deforms a part of a wall in an ink chamber to increase the volume of the ink chamber, and ink is supplied in the increased space inside the ink chamber. And, stopping the voltage supply to the piezoelectric actuator PZ, or applying a pulse waveform voltage of the reverse polarity against the foregoing pulse waveform deforms the part of the wall in the ink chamber in the reverse direction to decrease the volume of the ink chamber, thus discharging ink droplets through the nozzle.

FIG. 15 illustrates waveforms of the control signal S, a driving voltage signal VCp applied to the piezoelectric actuator PZ, and a displacement X of the piezoelectric actuator in the conventional circuit for driving an ink-jet head shown in FIG. 14.

In FIG. 15, an initial period T0, a charge period T1 having a pulse change, and a discharge period T2 constitute one printing cycle.

During the initial period T0, the control signal S is in low level, and the output of the first inverter U1 and the second inverter U2 shown in FIG. 14 are in high impedance.

When the output of the first inverter U1 and the second inverter U2 are in high impedance, each of the bases of the PNP transistor Q1 and the NPN transistor Q2 is biased by the power source voltage VH through the second resistor R2 and the third resistor R3.

Accordingly, the PNP transistor Q1 is nonconductive, and the NPN transistor Q2 is conductive, and the piezoelectric actuator PZ is discharged through the fifth resistor R5, so that the driving voltage signal VCp is at the ground potential, namely, zero volt.

When entering into the charge period T1, the control signal S rapidly goes up to the high level, which turns the outputs of the first inverter U1 and the second inverter U2 into low level, thus turning the NPN transistor Q2 nonconductive and the PNP transistor Q1 conductive. Consequently, the piezoelectric actuator PZ is charged by the power source voltage VH through the fourth resistor R4.

Accordingly, the drive voltage signal VCp goes up toward the power source voltage VH in accordance with a time constant by a product of a resistance of the fourth resistor R4 and an equivalent capacitance Cp of the piezoelectric actuator PZ. This voltage VCp charges the piezoelectric actuator PZ to fill ink into the ink chamber.

When entering into the discharge period T2, the control signal S rapidly goes down to low level, the output of the first inverter Ul and the second inverter U2 go back again to high impedance. Thereby, the PNP transistor Q1 turns nonconductive, the NPN transistor Q2 turns conductive. And then, the drive voltage signal VCp goes down toward the ground potential in accordance with a time constant by a product of a resistance of the fifth resistor R5 and an equivalent capacitance Cp of the piezoelectric actuator PZ, thereby discharging the piezoelectric actuator PZ to discharge ink through the ink chamber.

The rapid rise during the charge period T1 and the rapid fall during the discharge period T2 will generate free vibrations of the piezoelectric actuator PZ and the ink in the ink chamber by the intrinsic frequencies thereof and the free vibrations attenuate gently, which is illustrated in the displacement X of the piezoelectric actuator PZ in FIG. 15 as an example.

When the foregoing ink jet recording system is applied for printing characters and graphics and the like in which the density of dots on the recording media is maximum and constant, namely, when it is applied for printing such characters and graphics in general documents and reports, the recording system can display the full advantages.

However in recent years, picture images in which the intermediate density gradation is required to be presented in full colors continuously or in a step form, for example, three-dimensional picture images with shadows and photographic images and the like have frequently been brought into computer images or office automation equipment, and accordingly, these picture images are strongly desired to be printed in a high quality.

Several techniques have been put forward to display the intermediate density gradation, and one of the most popular techniques of the ink-jet recording system is the so-called dither or density pattern method, which displays one pixel of a printing picture image by means of plural dot groups.

Although the density pattern method varies the black dot number in one pixel of a picture image in a step form in accordance with the gradation, and devises the configuration of the dot pattern to display a pseudo gradation, there is a problem that the method displays one pixel of a printing image by means of plural dot groups, and therefore, the resolution of the printing image will remarkably deteriorate.

That is, to obtain a fine gradation in this density pattern method accompanies an increase of the dot number in one pixel, resulting in an increase of one pixel in the picture image, and the quality of a printing image is deteriorated even if a high resolution printer is used.

To obtain a high resolution picture quality, on the contrary, will result in a problem that a powerfully appealing picture with sufficient gradation cannot be acquired.

On the other hand, the so-called area gradation method has been proposed which directly controls areas of individual dots on recording media to vary the density. The multi-droplet method, which is an area gradation method, constitutes one dot with a set of plural fine ink droplets continuously discharged, controls a volume of ink droplets in accordance with the number of fine ink droplets, and thereby, varies the area of the dot on the recording media to add a gradation to the density.

However, this multi-droplet method needs to put plural fine ink droplets continuously discharged on a position that can be regarded as one picture element on a recording medium so as to form a picture element. Therefore, in a printer construction in which a recording head and a recording medium move continuously and relatively, the speed of response to discharge fine ink droplets has to be increased so as not to fluctuate with time positions on the recording medium at which ink droplets are put in order to acquire a high quality picture image.

It is regarded that the speed of response to discharge ink droplets in the multi-droplet method has to be 10 to 20 times higher than the speed of response of a general ink-jet head. Particularly, in the ink-jet head of the piezoelectric system, free vibrations are generated in the piezoelectric actuator and ink inside the ink chamber, and an discharging motion and the subsequent ink supply are repeated before the free vibrations attenuate.

Accordingly, ink droplets are split and atomized, making it difficult to form stable ink droplets and resulting in a problem that the speed of response cannot be increased.

Further, in the multi-droplet method, as ink droplets combine randomly in flight of fine ink droplets or owing to a flight direction thereof, the characteristics of ink droplets change influencing on the shape of a picture element and the stability when ink droplets are put on a recording medium, posing a problem in the stable discharge of continuous fine ink droplets.

Further, there is another method to display the density gradation, in which by controlling the driving voltage, the driving time or the driving waveform applied to a piezoelectric actuator of a head, a volume of ink droplets discharged from the head is directly controlled so as to vary the quantity of ink to be put on a recording medium, in other words, the area of dots.

This method exceeds in displaying gradation by discharge in a dot unit at each printing cycle, because by properly controlling the driving voltage, the driving waveform, or the time of the drive voltage to be applied to a piezoelectric actuator, a quantity of ink to be sucked into the ink chamber or a quantity of ink to be discharged can be controlled.

However, when the piezoelectric actuator is driven in this method, the amplitude, phase, attenuation time, etc. of the free vibrations generated in the piezoelectric actuator and the ink inside the ink chamber are changed due to the variation of the quantity of ink sucked into the ink chamber or the quantity of discharged ink. Accordingly, a position of a meniscus which is a face to discharge ink from is not stabilized, which accompanies a problem of dispersions of a diameter and discharge speed of ink droplets in the subsequent discharging motion, leading to an unstable discharging motion.

Furthermore, to vary the driving voltage, the driving waveform or the driving time applied to all of the piezoelectric actuators for each density that changes sequentially, it is necessary to prepare, for all of the piezoelectric actuators, respective circuits that generate the driving voltage, the driving waveform and the driving time, and drive the each driving circuit individually for each of the actuators, by which the entire driving circuits and control software become complicated, thus resulting in a difficulty to embody these.

The present invention has been made to solve the foregoing various problems of a conventional inkjet head printer and it is therefore an object of the invention to provide a circuit and a method for driving an ink-jet head that controls free vibrations of the piezoelectric actuator so as to discharge ink droplets of a stable quality with a virtually constant discharge time in a constant speed regardless of the size of ink droplets without deteriorating the resolution of the printing image by gradation in density.

DISCLOSURE OF THE INVENTION

In order to accomplish the foregoing object, a circuit for driving an ink-jet head according to the invention comprises a common drive waveform generator circuit that generates a driving voltage signal for driving a piezoelectric actuator for an ink-jet head, an analog/digital converter circuit that converts the driving voltage signal into drive waveform data of digital data, a gradation data separation/accumulation circuit that separates printing gradation data contained in printing data to be temporarily stored therein and outputs the data stored at a desired time, a data comparator circuit that compares the drive waveform data with the printing gradation data to output the comparison result as a comparison signal, a printing control circuit that outputs the presence of an ink discharge instruction signal contained in the printing data as a switch control signal, a switch control circuit that outputs a logical product by the comparison signal and the switch control signal as an analog switch control signal, and a bidirectional analog switch that controls conductivity of the driving voltage signal for driving the piezoelectric actuator in accordance with the analog switch control signal.

In the foregoing circuit for driving an ink-jet head, the analog/digital converter circuit and the data comparator circuit may be replaced by a timer circuit for supplying a timer signal in which the binary level varies at a timer time set in accordance with the printing gradation data, and the switch control circuit may output the logical product by the timer signal and the switch control signal as the analog switch control signal.

Or, the circuit for driving an ink-jet head may comprise a drive waveform data memory for storing the drive waveform data in which a driving voltage signal for driving a piezoelectric actuator for an ink-jet head is decomposed in a unit of time and converted into digital data, a memory control circuit that sequentially outputs address data for the drive waveform data memory with a constant time interval, a digital/analog converter circuit that converts the drive waveform data supplied by the drive waveform data memory into an analog signal to output, a power amplifier that amplifies a voltage and a current of the analog signal to output the drive voltage signal, the gradation data separation/accumulation circuit that separates the printing gradation data contained in the printing data to be temporarily stored therein and outputs the stored data at a desired timing, the data comparator circuit that compares the potential levels of the drive waveform data and the printing gradation data to output the comparison signal, the printing control circuit that judges the presence of the ink discharge instruction signal contained in the printing data to output the switch control signal, the switch control circuit that makes a logical product by the comparison signal and the switch control signal to output the analog switch control signal, and the bidirectional analog switch that controls conductivity of the driving voltage signal supplied by the power amplifier in accordance with the analog switch control signal and applies the driving voltage signal to the piezoelectric actuator.

In the foregoing circuit for driving an ink-jet head, the memory control circuit, drive waveform data memory, digital/analog converter circuit, power amplifier, gradation data separation/accumulation circuit, and printing control circuit are commonly used for all of the piezoelectric actuators provided in an ink-jet head.

On the other hand, the data comparator circuit, switch control circuit, and bidirectional analog switch are individually provided for each piezoelectric actuator provided in an ink-jet head.

Further, a power source voltage for driving the piezoelectric actuator is supplied to the power amplifier and the bidirectional analog switch, and a standard logic voltage is supplied to each other circuit except the foregoing.

Furthermore, in the foregoing circuit for driving an ink-jet head, the digital/analog converter circuit may convert the drive waveform data supplied by the drive waveform data memory into an analog signal of a level capable of directly driving the piezoelectric actuator, and a current amplifier that amplifies a current of the analog signal may be provided to supply the driving voltage signal instead of the power amplifier.

A method of driving an ink-jet head according to the invention controls the size of ink droplets discharged from the ink-jet head in accordance with the printing gradation data signal, whereby a driving voltage signal for driving a piezoelectric actuator for an ink-jet head is generated, the driving voltage signal is converted into drive waveform data of digital data, printing gradation data contained in printing data is separated to be temporarily stored and the data stored is supplied at a desired timing, the drive waveform data is compared with the printing gradation data to supply a comparison signal, the presence of an ink discharge instruction signal contained in the printing data is judged to supply a switch control signal, a logical product is made by the comparison signal and the switch control signal to supply an analog switch control signal, and the analog switch control signal controls a bidirectional analog switch to control conductivity of the driving voltage signal for driving the piezoelectric actuator.

In the foregoing method of driving an ink-jet head, in stead of converting the driving voltage signal into the drive waveform data, comparing the drive waveform data with the printing gradation data, and supplying the comparison signal, a timer signal in which the binary level varies at a timer time set in accordance with the printing gradation data may be produced, and the logical product by the timer signal and the switch control signal may be made to supply the analog switch control signal.

In these foregoing methods of driving an ink-jet head, the driving voltage signal preferably generates a voltage signal comprising an initial voltage generated during an initial period whereby an ink chamber of the ink-jet head is set to an initial state, a first ink supply voltage generated during a first ink supply period that varies rapidly with time whereby ink is rapidly supplied into the ink chamber, a second ink supply voltage generated during a second ink supply period that varies gently with time whereby ink is gently supplied into the ink chamber, an ink discharge voltage generated during an ink discharge period that varies rapidly with time in the reverse direction to those of the first and second ink supply voltage whereby ink inside the ink chamber is rapidly discharged, and a restoring voltage generated during a restoring period whereby the ink chamber is restored to the initial state.

Or, the foregoing driving voltage signal may generate a voltage signal comprising the initial voltage generated during the initial period whereby an ink chamber of the inkjet head is set to the initial state, an ink supply voltage generated during an ink supply period that varies gently with time whereby ink is gently supplied into the ink chamber, an ink discharge voltage generated during an ink discharge period that varies rapidly with time in the reverse direction to that of the ink supply voltage whereby ink inside the ink chamber is rapidly discharged, and the restoring voltage generated during the restoring period whereby the ink chamber is restored to the initial state.

And, preferably the driving voltage signal is supplied to the piezoelectric actuator in such a manner that the drive waveform data produced by converting the driving voltage signal into digital data is compared with the printing gradation data to reverse the comparison signal or the timer signal at a point where the drive waveform data first crosses the printing gradation data, the comparison signal or the timer signal is again reversed at a point where the drive waveform data next crosses the printing gradation data, and the bidirectional analog switch is made conductive except for a period where the comparison signal or the timer signal is first reversed.

In the method of driving an ink-jet head according to the invention, the driving voltage signal may be controlled in conductivity and applied to the piezoelectric actuator in such a manner that the drive waveform data memory outputs synchronously with address data the drive waveform data of digital data corresponding to the driving voltage signal for driving the piezoelectric actuator for an ink-jet head, the drive waveform data is converted into an analog signal, a voltage and a current of the analog signal are amplified into a power to output the drive voltage signal, the printing gradation data contained in the printing data is separated to be temporarily stored as digital data and the stored data is outputted at a desired timing, the potential levels of the drive waveform data and the printing gradation data are compared to the output of the comparison signal, the presence of the ink discharge instruction signal contained in the printing data is judged to output the switch control signal, the logical product is made by the comparison signal and the switch control signal to output the analog switch control signal, and the analog switch control signal controls the bidirectional analog switch to control conductivity of the drive voltage signal.

In the foregoing method of driving an ink-jet head, the drive waveform data may be converted into an analog signal of a level that can directly drive the piezoelectric actuator and a current of the analog signal may be amplified to supply the drive voltage signal.

In these foregoing methods of driving an ink-jet head, the drive waveform data memory preferably outputs the drive waveform data produced by converting into digital data the driving voltage signal comprising an initial voltage waveform generated during an initial period whereby an ink chamber of the ink-jet head is set to an initial state, a first ink supply voltage waveform generated during a first ink supply period that varies rapidly with time whereby ink is rapidly supplied into the ink chamber, a second ink supply voltage waveform generated during a second ink supply period that varies gently with time whereby ink is gently supplied into the ink chamber, an ink discharge voltage waveform generated during an ink discharge period that varies rapidly with time in the reverse direction to those of the first and second ink supply voltage whereby ink inside the ink chamber is rapidly discharged, and a restoring voltage waveform generated during a restoring period whereby the ink chamber is restored to the initial state.

And, the size of ink droplets discharged from an ink-jet head ispreferably controlled in accordance with the printing gradation data in such a manner that the drive waveform data is compared with the printing gradation data to reverse the comparison signal at a point where the drive waveform data first crosses the printing gradation data, the comparison signal is again reversed at a point where the drive waveform data next crosses the printing gradation data, and the bidirectional analog switch is made conductive to supply the driving voltage signal to the piezoelectric actuator except for a period where the comparison signal is first reversed.

BEST MODE FOR CARRYING OUT THE INVENTION

Best mode for carrying out the invention will be described hereinafter with reference to the drawings.

Figure 3:
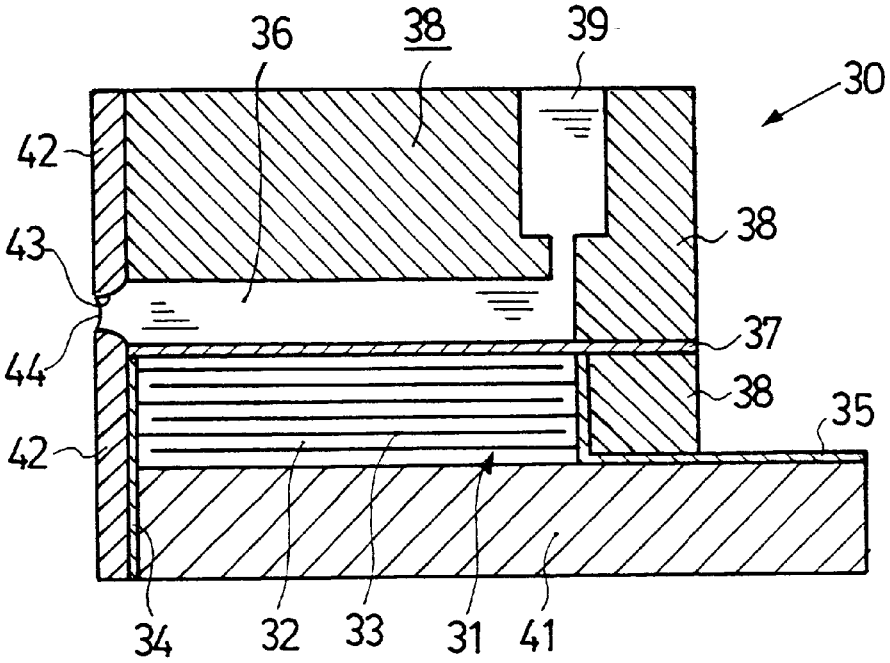
FIG. 3 is a sectional side view of the ink-jet head applied in the embodiment according to the invention.
Figure 4:
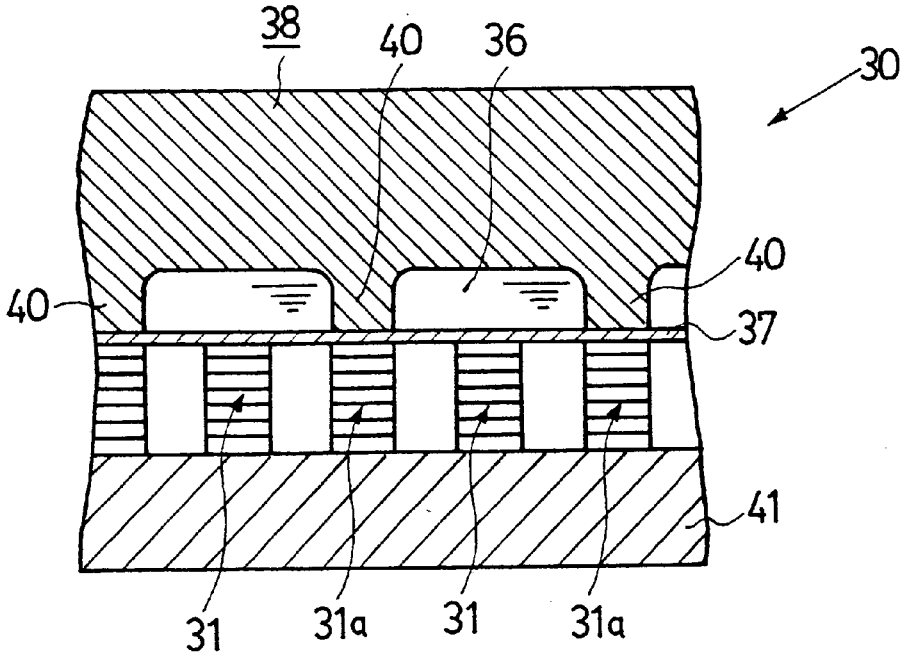
FIG. 4 is a transverse sectional view thereof.

First, the construction of the ink-jet head used in the respective embodiments according to the invention will be described with reference to FIG. 3 and FIG. 4. FIG. 3 is the sectional side view of the ink-jet head, and FIG. 4 is the transverse sectional view thereof.

The ink-jet head shown in these figures uses laminated type piezoelectric actuators.

The ink-jet head 30 has a construction such that laminated type piezoelectric actuators 31 each having the piezoelectric strain constant d33 deform ink chambers 36. In the ink-jet head 30, the piezoelectric actuators 31, each of which is made by alternately laminating a piezoelectric material 32 polarized in its thickness direction and a conductive material 33, are disposed on a substrate 41 with a constant space and glued thereon.

Each piezoelectric actuator 31 is provided with a first connector electrode 34 on the front end side and a second connector electrode 35 on the rear end side. Applying a voltage across the first connector electrode 34 and the second connector electrode 35 will deform the piezoelectric actuator 31 in the thickness (d33) direction. The first connector electrode 34 is connected commonly to all of the piezoelectric actuators 31, and the second connector electrode 35 is led out individually from each piezoelectric actuator 31.

On the top of the piezoelectric actuators 31, a thin diaphragm 37 is glued, and further, a channel member 38 is glued on the diaphragm 37.

Ink chambers 36 are formed with a certain space in the channel member 38, and each ink chamber 36 faces each piezoelectric actuator 31 with the diaphragm 37 placed in-between.

Each ink chamber 36 is provided with a supply port 39, and each supply port 39 is coupled with an ink cartridge (not illustrated) as an ink supply source.

The respective front end side of the substrate 41, the piezoelectric actuator 31, the diaphragm 37, and the channel member 38 forming the first connector electrode 34 are flush with each other, and a nozzle board 42 is glued on the front end side.

The nozzle board 42 is provided with a plurality of nozzles 43. The nozzles 43 are openings for the ink chambers 36 formed in the channel member 38. Accordingly, to fill ink into the ink chambers 36 from the ink cartridge will form meniscuses 44 in the nozzles 43.

As shown in FIG. 4, the piezoelectric actuators 31 that are disposed on the substrate 41 and glued thereon, alternately face partitions 40 formed between the ink chambers 36 of the channel member 38. Piezoelectric actuators 31*a* facing the partitions 40 are not driven and function as supports.

Before the description of the embodiments, the driving voltage signal supplied to the piezoelectric actuator 31 and the displacement signal to the piezoelectric actuator 31 will be described.

Figure 5:
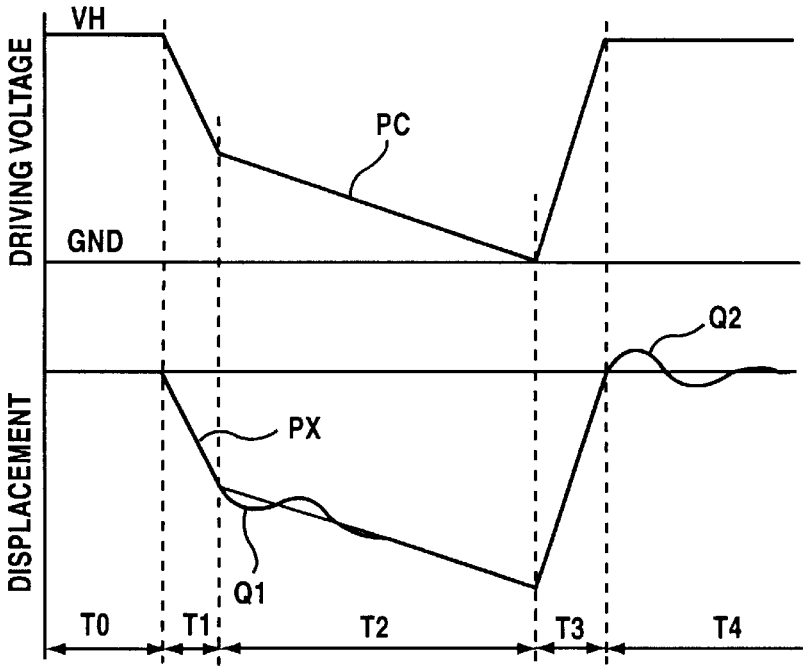
FIG. 5 is a chart showing a waveform of a driving voltage signal applied to a piezoelectric actuator of the ink-jet head shown in FIG. 3 and FIG. 4 and a waveform of displacement of the piezoelectric actuator.

FIG. 5 illustrates waveforms of a driving voltage signal PC applied to the piezoelectric actuator 31 and a displacement PX of the piezoelectric actuator 31.

The waveform of the driving voltage signal PC shown in FIG. 5 comprises five parts as follows.

The first part is an initial voltage waveform generated in an initial period T0 during which the piezoelectric actuator 31 is charged to set the initial state.

The second part is a first ink supply voltage waveform rapidly varying with time, generated in a first ink supply period T1 during which the piezoelectric actuator 31 is rapidly discharged and ink is supplied into the ink chamber.

The third part is a second ink supply voltage waveform gently varying with time, generated in a second ink supply period T2 during which the piezoelectric actuator 31 is discharged gently compared to that in the first ink supply period T1 and ink is supplied into the ink chamber.

The fourth part is an ink discharge voltage waveform rapidly varying with time in the reverse direction to the first and second ink supply voltage waveform, generated in an ink discharge period T3 during which the piezoelectric actuator 31 is rapidly charged and ink is discharged from the ink chamber.

The last part is a restoring voltage waveform generated in a restoring period T4 during which the state of the ink chamber is restored to the initial state.

The displacement PX shown in FIG. 5 illustrates an example of the displacement of the piezoelectric actuator 31 to which the driving voltage signal 51 is applied, from the initial period T0 through the first ink supply period T1, the second ink supply period T2, and the ink discharge period T3 to the restoring period T4.

The rapid discharge during the first ink supply period T1 produces a natural vibration Q1 in the early stage of the second ink supply period T2, and the rapid charge during the ink discharge period T3 produces a natural vibration Q2 in the early stage of the restoring period T4.

The second ink supply period T2 also functions as quickly suppressing the natural vibration Q1 produced by the rapid discharge during the first ink supply period T1 in the piezoelectric actuator 31 and the ink in the ink chamber 36.

Experiment results confirm that setting the second ink supply period T2 to about an integer multiple of the period of the natural vibration Q1 can suppress the vibration more effectively. The restoring period T4 quickly suppresses the natural vibration Q2 produced by the rapid charge during the ink discharge period T3.

FIG. 6 is a sectional view showing a concept of motion of the ink-jet head used in the embodiments according to the invention. (a) shows a state in the initial period T0 in FIG. 5. (b) shows a state in the first ink supply period T1 in FIG. 5. (c) shows a state in the second ink supply period T2 in FIG. 5. (d) shows a state in the ink discharge period T3 in FIG. 5.

A state in the restoring period T4 in FIG. 5 settles into the same state as that of the initial period T0 in FIG. 6 (*a*).

A sequence of periods from the initial period T0, first ink supply period T1, second ink supply period T2, ink discharge period T3, and restoring period T4 constitutes one printing cycle. A printing standby period may or may not be interposed between the restoring period T4 and an initial period T0 of the subsequent printing cycle.

As shown in FIG. 6, in the piezoelectric type ink-jet head, a part of the wall of the ink chamber 36 is formed of the diaphragm 37, which can freely deform. The piezoelectric actuator 31 is fastened to the freely deformable diaphragm 37, and deforming the piezoelectric actuator 31 deforms the diaphragm 37. The ink chamber 36 communicates with the nozzle 43 as well as the ink supply source (not illustrated) through the ink supply port 39.

The basic operation of driving the ink-jet head will be described with reference to FIG. 5 and FIG. 6.

First, in the initial period T0 shown in FIG. 5, the driving voltage signal PC applied to the piezoelectric actuator 31 is at the power source voltage VH which is the maximum voltage. At this moment, as shown in FIG. 6(*a*), the piezoelectric actuator 31 deforms to extend the thickness thereof to the maximum. The diaphragm 37 is pressed up, and the volume of the ink chamber 36 is at its minimum.

The meniscus 44 being an interface between the ink and the air, formed in the nozzle 43 balances in a slight concave. Further, the piezoelectric actuator 31 electrically equivalent to an electrostatic capacitor stores charges at maximum.

Next, in the first ink supply period T1, a voltage of the first ink supply voltage waveform that rapidly decreases the driving voltage signal PC is applied to the piezoelectric actuator 31. Accordingly, a large amount of discharge current flows through the piezoelectric actuator 31 to be rapidly discharged. Thereby, the piezoelectric actuator 31 decreases the thickness compared with that in the initial period as shown in FIG. 6(*b*) with the arrow, which rapidly deforms the ink chamber 36 so as to increase the volume.

Accompanying with the deformation of the piezoelectric actuator 31, the diaphragm 37 of the ink chamber 36 deforms to pull the meniscus 44 formed in the nozzle 43. At the same time, the ink is led out into the ink chamber 36 from the ink supply source through the ink supply port 39.

In the first ink supply period T1, ink is supplied into the ink chamber 36 quickly and reliably. However, as the first ink supply period T1 finishes, free vibrations in which the vibration of the ink and the natural vibration of the piezoelectric actuator 31 are superimposed are generated in the ink inside the ink chamber 36 and the meniscus 44.

In the second ink supply period T2, the driving voltage signal PC varies more gently than that in the first ink supply period T1, which is applied to the piezoelectric actuator 31. Thereby, the piezoelectric actuator 31 is gently discharged, and the piezoelectric actuator 31 recovers the original shape that is not deformed as shown in FIG. 6(*c*), thus increasing the volume of the ink chamber 36 gently.

The gradual deformation recovery motion of the piezoelectric actuator 31 in the second ink supply period T2 acts as damping the amplitude of free vibrations generated after the first ink supply period T1 (hereunder, mentioned as "damping action"). This damping action damps the vibration amplitude of the ink inside the ink chamber 36.

The damping action to the free vibrations of the piezoelectric actuator 31 and the ink is exerted especially remarkably when the second ink supply period T2 is set to about an integer multiple of the natural vibration period of the piezoelectric actuator 31.

Next, in the ink discharge period T3, the driving voltage signal PC that rapidly increases, namely, the ink discharge voltage is applied to the piezoelectric actuator 31.

Then, the piezoelectric actuator 31 is quickly charged to rapidly expand in the thickness direction of the arrow shown in FIG. 6(*d*). Thereby, the ink chamber 36 is rapidly deformed in the direction that the volume thereof which was increased during the first ink supply period T1 and the second ink supply period T2 is decreased.

Accordingly, the pressure inside the ink chamber 36 increases rapidly, and in consequence, the meniscus 44 rushes out of the nozzle 43 to form ink droplets. Setting the ink discharge period T3 virtually equally to the natural vibration period of the piezoelectric actuator 31 will damp the amplitude of the free vibrations in the piezoelectric actuator 31 generated when the ink discharge period T3 finishes, and therefore, the printing cycle can be repeated in a shorter period.

The restoring period T4 is to damp free vibrations generated when the ink discharge period T3 finishes and to recover the initial state. In order to reduce a repetition period of the printing cycle, it is necessary to reduce the sum of the initial period T0 and the restoring period T4 as much as possible to such a degree that the free vibrations generated after the ink discharge period T3 do not give influence on the subsequent first ink supply period.

Figure 7:
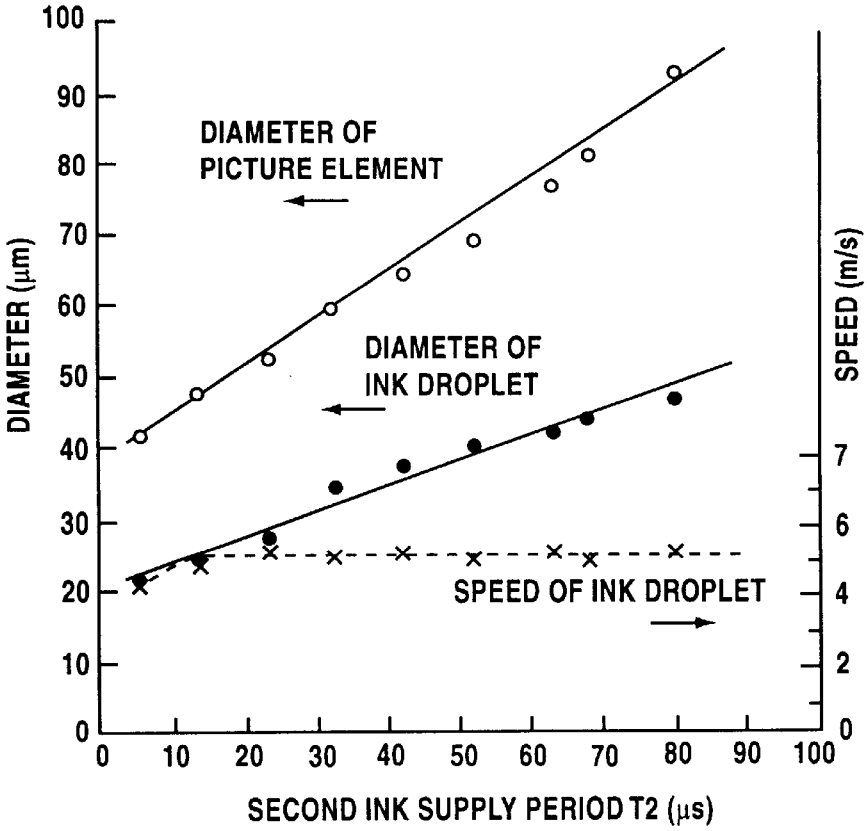
FIG. 7 is a graph showing a result of an experiment to control ink droplets by the ink-jet head driven by the driving voltage signal shown in FIG. 5.
Figure 6A:
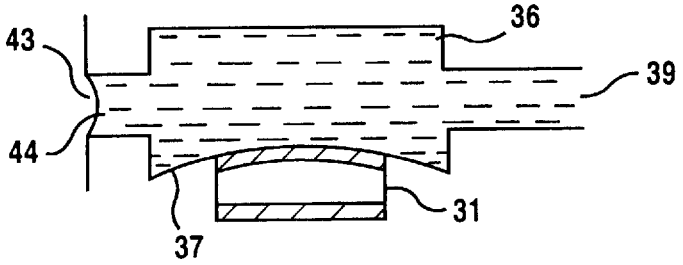
FIG. 6 is a sectional view showing a concept of motion of the ink-jet head used in the invention.
Figure 6B:
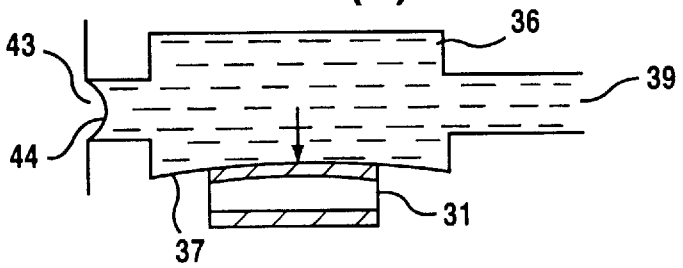
Figure 6C:
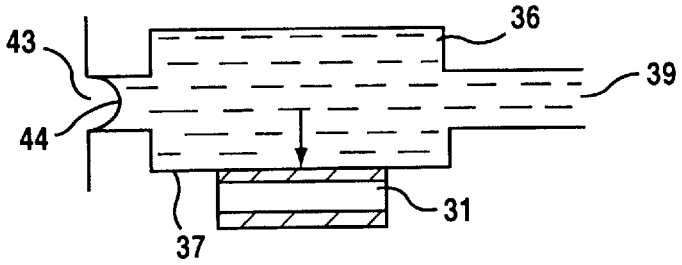
Figure 6D:
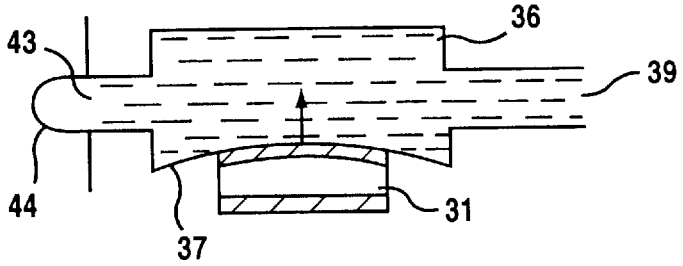

FIG. 7 is a graph showing example of an experiment data when the ink-jet head having a construction shown in FIG. 3 and FIG. 4 is driven to discharge ink. Namely, it illustrates graphs of the measured diameter and speed of discharged ink droplets and the diameter of picture elements formed on a printing paper by discharged ink droplets, when the driving voltage signal PC shown in FIG. 5 is applied to the ink-jet head, the ink supply being ended in the middle of the second ink supply period T2, and going into the motion in the ink discharge period T3.

In FIG. 7, the scale of the diameter of discharged ink droplets and the diameter of picture elements formed on a printing paper is shown on the left to the left axis of ordinate in micro meter ($\mu$m) of an identical measure unit. The scale of the speed of discharged ink droplets is shown on the right to the right axis of ordinate in meter/second (m/s). The axis of abscissa assumes a scale of the second ink supply period T2 in micro second ($\mu$S), which is common to the right and left axes of ordinate.

The period of natural vibration of the piezoelectric actuator 31 of the ink-jet head applied in this experiment was about 12 $\mu$sec, the diameter of the nozzle 43 was 40 $\mu$m, and the volume of the ink chamber 36 was 0.15 $mm^3$. The viscosity of the ink used was 3.1 centipoise, and the surface tension of the ink was 43 dyne/centimeter.

Further, the driving voltage signal PC in FIG. 5 applied in this experiment was 40 V in the initial period T0, the first ink supply period T1 was 15.4 $\mu$sec, the first ink supply voltage at the time the first ink supply period T1 ends was 27.4 V, the second ink supply voltage applied during the second ink supply period T2 linearly varying with time was 19.2 V when the second ink supply period T2 passed 80 $\mu$sec, and the ink discharge period T3 was 8 $\mu$sec.

As clearly seen in FIG. 7, the diameter of discharged ink droplets and the diameter of picture elements formed on a printing paper, although there are slight deviations, increase virtually linearly against the second ink supply period T2, showing that there are proportional relations therebetween.

The speed of discharged ink droplets was almost constant at about 5.1 m/sec, although the speed decreased slightly when the second ink supply period T2 was shorter than 10 $\mu$sec.

Thus, in driving the ink-jet head by the driving voltage signal PC shown in FIG. 5, varying the second ink supply period T2, or varying the second ink supply voltage can control the diameter of discharged ink droplets considerably freely.

And obviously, the diameter of a picture element formed by adhering the ink droplets of a controlled diameter on a printing paper can also be controlled by varying the second ink supply period T2, or varying the second ink supply voltage T2. In other words, this demonstrates that varying the density of a picture image in a minimum picture element of a dot discharged by the ink-jet head can display the gradation.

[First Embodiment]

A circuit for driving an ink-jet head and a method of driving the same of the first embodiment according to the invention will now be described.

Figure 1:
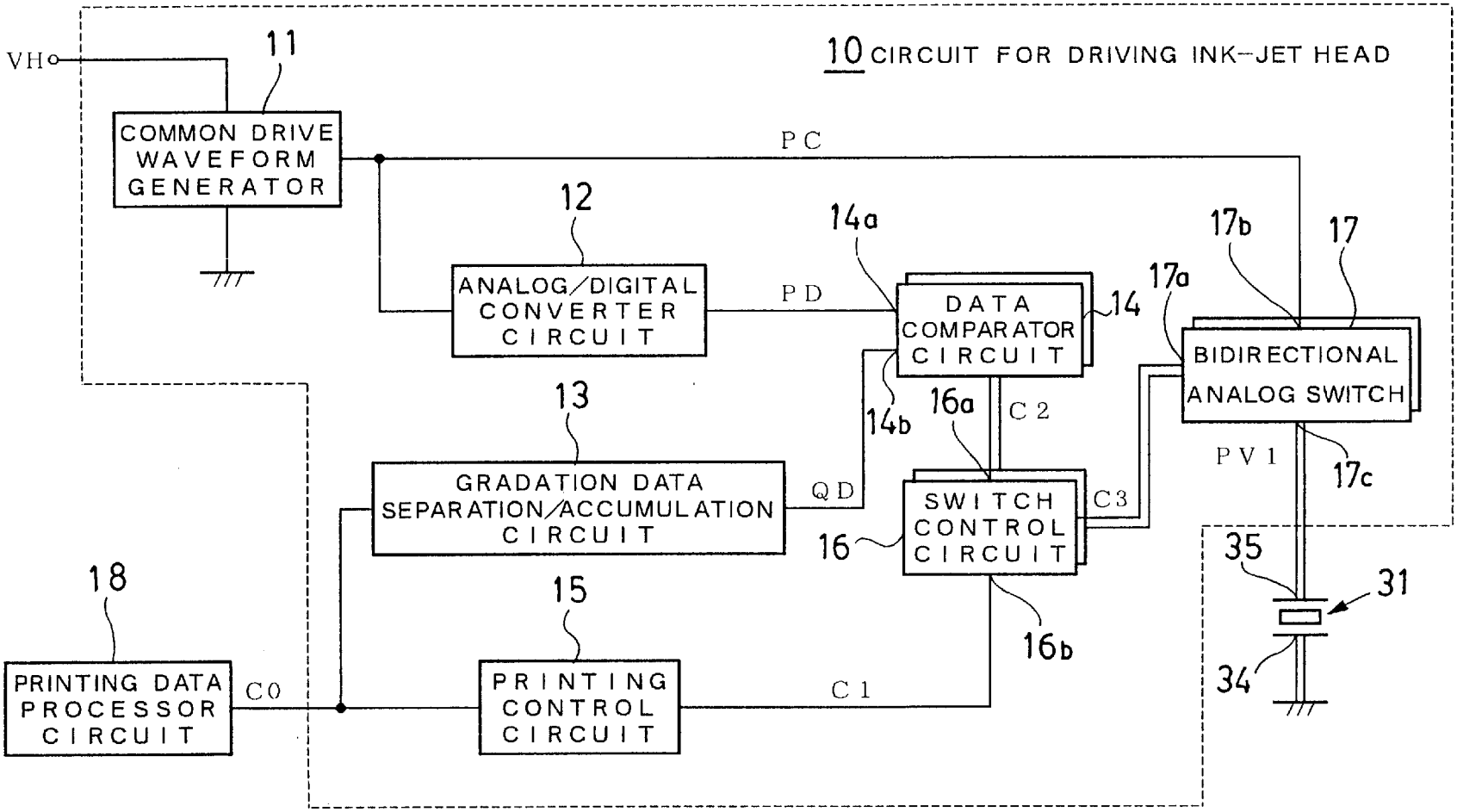
FIG. 1 is a block diagram showing a construction of a circuit for driving an ink-jet head of a first embodiment according to the invention.

FIG. 1 is a block diagram showing a construction of the circuit for driving an ink-jet head of the first embodiment according to the invention.

A circuit 10 for driving an ink-jet head shown in FIG. 1 comprises a common drive waveform generator 11, analog/digital converter circuit 12, gradation data separation/accumulation circuit 13, data comparator circuit 14, printing control circuit 15 including software and hardware, switch control circuit 16, and bidirectional analog switch 17, and drives piezoelectric actuator 31 of the ink-jet head in accordance with printing data entering from a printing data processor circuit 18.

In the circuit construction of FIG. 1, the common drive waveform generator 11, analog/digital converter circuit 12, gradation data separation/accumulation circuit 13, and printing control circuit 15 are commonly used for all of the actuators 31 provided in the ink-jet head.

The data comparator circuit 14, switch control circuit 16, and bidirectional analog switch 17 each are provided for each piezoelectric actuator 31 of the ink-jet head (these circuit blocks and connection lines are indicated by double lines).

The common drive waveform generator 11 is a circuit to generate the driving voltage signal PC for driving the piezoelectric actuator 31, and is connected to the power source voltage VH and the respective ground line.

The output of the common drive waveform generator 11, namely, the driving voltage signal PC inputs to an input terminal of the analog/digital converter circuit 12 and one input output terminal 17*b* of all the bidirectional analog switch 17.

The analog/digital converter circuit 12 is a circuit to convert the driving voltage signal PC of an analog signal into digital drive waveform data PD. The output of the analog/digital converter circuit 12, namely, the digital drive waveform data PD inputs to one input terminal 14*a* of all the data comparator circuit 14.

A comparison signal C2 being the output from the data comparator circuit 14 corresponding to each piezoelectric actuator 31 inputs to one input terminal 16*a* of each switch control circuit 16 corresponding to each piezoelectric actuator 31.

The printing data processor circuit 18 outputs a printing control signal C0 containing printing data, which inputs to the gradation data separation/accumulation circuit 13 and the printing control circuit 15.

The gradation data separation/accumulation circuit 13 separates printing gradation data for each of the piezoelectric actuators 31 contained in the printing data from the printing control signal C0, stores the separated data temporarily therein, lines up the timing, and outputs printing gradation data QD. The printing gradation data QD inputs to the other input terminal 14*b* of each data comparator circuit 14 corresponding to each piezoelectric actuator 31.

The printing control circuit 15 is a circuit to judge the presence of the printing data for each piezoelectric actuator 31 by the printing control signal C0, and outputs a switch control signal C1 in accordance with the determination of the presence of the printing data. The switch control signal C1 inputs to the other input terminal 16*b* of each switch control circuit 16 corresponding to each piezoelectric actuator 31.

An analog switch control signal C3 being the output of each switch control circuit 16 corresponding to each piezoelectric actuator 31 inputs to a control terminal 17*a* of each bidirectional analog switch 17 corresponding to each piezoelectric actuator 31.

The other input output terminal 17*c* of the bidirectional analog switch 17 is connected to a second connector electrode 35 corresponding to each piezoelectric actuator 31. A first connector electrode 34 (see FIG. 3) of each piezoelectric actuator 31 is commonly connected to the ground.

Figure 2:
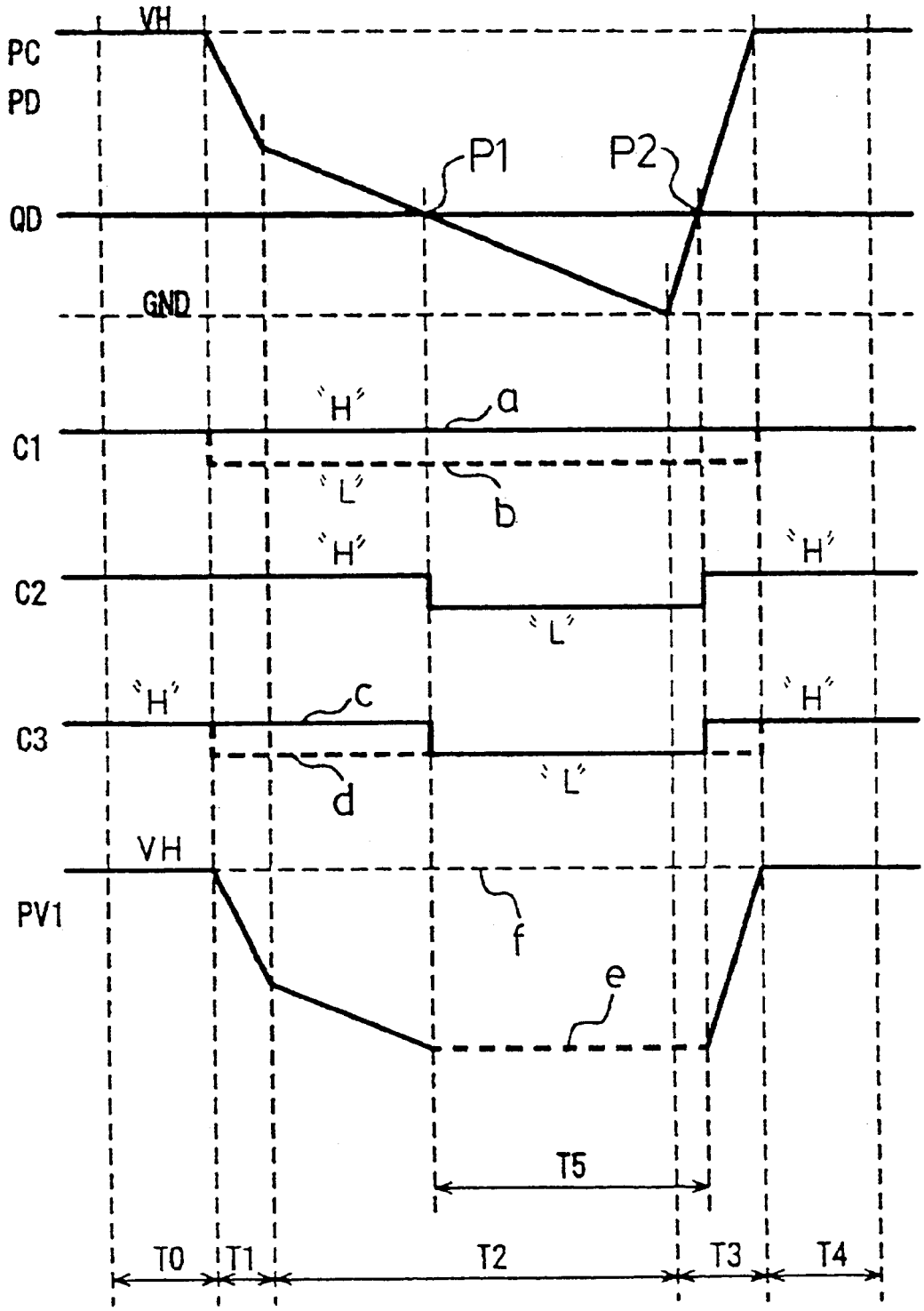
FIG. 2 is a chart showing respective signal waveforms for explaining the operation of the driving circuit shown in FIG. 1.

FIG. 2 is a chart showing respective signal waveforms for explaining the operation of the circuit 10 for driving an ink-jet head of the first embodiment.

Namely, this chart displays the driving voltage signal PC supplied by the common drive waveform generator 11, the drive waveform data PD supplied by the analog/digital converter circuit 12 for converting the driving voltage signal PC into digital data, the printing gradation data QD supplied by the gradation data separation/accumulation circuit 13, the switch control signal C1 supplied by the printing control circuit 15, the comparison signal C2 supplied by the data comparator circuit 14, the analog switch control signal C3 supplied by switch control circuit 16, and a terminal voltage PV1 generated at the second connector electrode 35 (see FIG. 3) of the piezoelectric actuator 31.

The drive waveform data PD is a result obtained by converting the driving voltage signal PC into digital data, and both are superimposed on one waveform in FIG. 2. The printing gradation data QD is also shown on the same graph as the former two with the necessity of comparison to the drive waveform data PD.

The driving voltage signal PC shown in FIG. 2 is equivalent to the driving voltage signal PC shown in FIG. 5. The abscissa for the waveform chart shown in FIG. 2 is a time axis to show passage of time, and it indicates a time passage equivalent to one printing cycle in the same manner as in FIG. 5.

The period for one printing cycle consists of the initial period T0 in which an initial voltage is generated, the first ink supply period T1 during which the first ink supply voltage rapidly varying with time is generated, the second ink supply period T2 during which the second ink supply voltage gently varying with time is generated, the ink discharge period T3 during which the ink discharge voltage rapidly varying with time in the reverse direction to the second ink supply voltage is generated, and the restoring period T4 during which the restoring voltage to restore the ink chamber to the initial state is generated.

The vertical axis of ordinate for the waveforms in FIG. 2 appropriately indicates a voltage or a magnitude of digital quantity, or a logical level.

Next, the method of driving an ink-jet head by the driving circuit 10 of the first embodiment according to the invention will be described with reference to FIG. 1 and FIG. 2.

The method of driving an ink-jet head by the driving circuit 10 is originally intended to drive multiple piezoelectric actuators 31 in different states. However, in order to simplify the description, only one piezoelectric actuator is focused on, and the method of driving this one will now be described.

First, the printing data processor circuit 18 is incorporated in a printer body, processes picture image data to be printed that a host computer transmits, outputs the printing control signal C0 containing the gradation data and a discharge instruction to the gradation data separation/accumulation circuit 13 and the printing control circuit 15.

The gradation data separation/accumulation circuit 13 separates the gradation data from the printing control signal C0 containing a printing data, stores the separated data temporarily in the memory incorporated therein, and outputs the printing gradation data QD to the input terminal 14*b* of the data comparator circuit 14 during the initial period T0, synchronously with a printing start instruction issued by the software of the printing control circuit 15.

The printing gradation data QD approaches the ground level as the printing density becomes thick, and approaches the power source voltage VH as the printing density becomes thin.

On the other hand, the printing control circuit 15 judges the presence of the printing data from the printing control signal C0 containing the printing data, and outputs the switch control signal C1 of a high or low logic level to the input terminal 16*b* of the switch control circuit 16 during the three periods of the first ink supply period T1, second ink supply period T2, and ink discharge period T3, synchronously with the printing start instruction.

The switch control signal C1 is always in high level during the two periods of the initial period T0 and restoring period T4 regardless of the presence of the printing data. During the three periods of the first ink supply period T1, second ink supply period T2, and ink discharge period T3, when the printing data is present, the switch control signal C1 is in high level as shown in FIG. 2 with a solid line a, and when the printing data is not present, it is in low level as shown in FIG. 2 with a dotted line b.

The common drive waveform generator 11 outputs the driving voltage signal PC to the analog/digital converter circuit 12 and the bidirectional analog switch 17, synchronously with the printing start instruction. The analog/digital converter circuit 12 sequentially converts the driving voltage signal PC into digital data, and outputs the drive waveform data PD to the input terminal 14*a* of the data comparator circuit 14.

The comparison signal C2 supplied by the data comparator circuit 14 compares the drive waveform data PD with the printing gradation data QD, and goes high level "H" when the drive waveform data PD is higher than the printing gradation data QD in the digital data, and goes low level "L" when the drive waveform data PD is lower than the printing gradation data QD.

The comparison signal C2 shown in FIG. 2 goes low level "L" when the drive waveform data PD is lower than the printing gradation data QD in the digital data, that is, during a period T5 defined as a period from the first intersection P1 by the drive waveform data PD and the printing gradation data QD to the second intersection P2, and goes high level "H" during the period except during the period T5.

The switch control circuit 16 outputs the analog switch control signal C3 being a logical product of the switch control signal C1 and the comparison signal C2 to the control terminal 17*a* of the bidirectional analog switch 17.

The bidirectional analog switch 17 is a switch device that makes conductive the circuit between the input output terminal 17*b* and the other input output terminal 17*c* when the control terminal 17*a* is in high level, and that makes nonconductive the circuit therebetween when the control terminal 17*a* is in low level.

Therefore, when the printing data is present, the analog switch control signal C3 goes low level "L" only during the period T5 as shown in FIG. 2 with a solid line c, and accordingly, the bidirectional analog switch 17 becomes nonconductive. Since the driving voltage signal PC is cut off only during the period T5, the terminal voltage PV1 shown in FIG. 2 generated at the second connector electrode 35 of the piezoelectric actuator 31 holds, by the charges stored in the piezoelectric actuator 31, the potential (shown in FIG. 2 with a thick dotted line e) of the driving voltage signal PC immediately before being cut off.

When the printing data is not present, since the analog switch control signal C3 goes low level "L", as shown in FIG. 2 with a dotted line d, during the three periods of the first ink supply period T1, the second ink supply period T2, and the ink discharge period T3, the bidirectional analog switch 17 becomes nonconductive during these three periods. Thereby, the terminal voltage PV1 generated at the second connector electrode 35 of the piezoelectric actuator 31 holds a potential virtually equivalent to the power source voltage VH, as shown in FIG. 2 with a thin dotted line f, during the three periods of the first ink supply period T1, the second ink supply period T2, and the ink discharge period T3.

As described above with reference to FIG. 7, varying the second ink supply period T2 can control the diameter of ink droplets discharged and the diameter of a picture element on a printing paper, whereby the density gradation can be added on a picture image to be printed in a picture element.

Therefore, according to the circuit 10 for driving the ink-jet head and the method of driving the ink-jet head using the circuit of the first embodiment of the invention, it is understood that varying the second ink supply period T2 can control the diameter of ink droplets and can add the gradation of density on a picture image.

As obvious from the foregoing description of the first embodiment, if the density of printing gradation data in the printing data given by the printing data processor circuit 18 is low, the bidirectional analog switch 17 becomes nonconductive when the driving voltage signal PC is high, and the deformation of the piezoelectric actuator 31 becomes small and the volume of ink drawn in by deforming the ink chamber 36 becomes small as already described with reference to FIG. 3 and FIG. 4, and accordingly, the volume of ink droplets discharged by the piezoelectric actuator 31 also becomes small.

On the contrary, if the density of printing gradation data in the printing data is high, the bidirectional analog switch 17 becomes nonconductive when the driving voltage signal PC is low, and therefore the deformation of the piezoelectric actuator 31 becomes large and the volume of ink drawn in by deforming the ink chamber 36 becomes large, and the volume of ink droplets discharged becomes large.

Therefore, when the value of the printing gradation data QD is minimum, the whole voltage waveform of the driving voltage signal PC is applied to the piezoelectric actuator 31 so that the volume of ink droplets discharged by the piezoelectric actuator 31 becomes maximum. In other words, in the first embodiment of the invention, the gradation control only needs to set the printing gradation data QD to a low value when making the gradation high (thick), and to a high value when making the gradation low (thin).

It is natural to reduce leakage of charges from the piezoelectric actuator 31, or to maintain the insulation resistance as high as possible while the bidirectional analog switch 17 is nonconductive. However, assuming charge leakage due to dispersion on a production line, in the first embodiment of the invention, the piezoelectric actuator 31 is charged in advance by applying a voltage almost equal to the power source voltage VH during the initial period T0 as a charging compensation period before the first ink supply period T1.

[Second Embodiment]

Next, a circuit for driving an ink-jet head and a method of driving the same of the second embodiment according to the invention will now be described.

Figure 8:
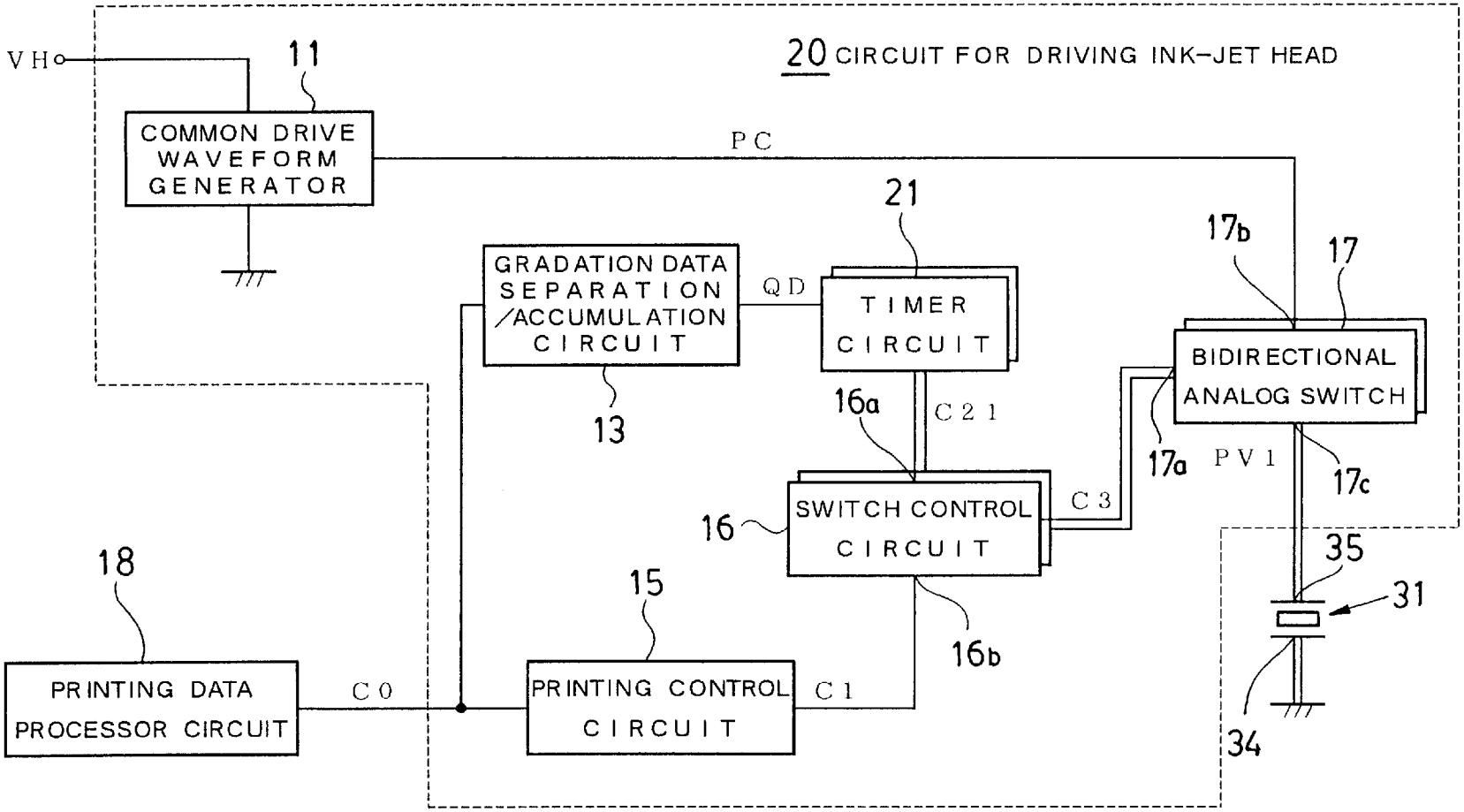
FIG. 8 is a block diagram showing a construction of a circuit for driving an ink-jet head of a second embodiment according to the invention.

FIG. 8 is a block diagram showing a construction of a circuit for driving an ink-jet head of the second embodiment according to the invention. In FIG. 8, the same parts as in FIG. 1 are given the identical symbols.

The only difference between a circuit 20 for driving an ink-jet head of the second embodiment and the driving circuit 10 of the first embodiment shown in FIG. 1 lies in that the analog/digital converter circuit 12 and the data comparator circuit 14 in FIG. 1 are replaced by a timer circuit 21 in FIG. 8.

Also, in this driving circuit 20, the common drive waveform generator 11, gradation data separation/accumulation circuit 13, and printing control circuit 15 are commonly used for all of the piezoelectric actuators 31 provided in the ink-jet head. The timer circuit 21, switch control circuit 16, and bidirectional analog switch 17 each are provided for each piezoelectric actuator 31 (these circuit blocks and connection lines are indicated by double lines).

In the driving circuit 20, the output of the gradation data separation/accumulation circuit 13, namely, the printing gradation data QD inputs to an input terminal of each timer circuit 21 corresponding to each piezoelectric actuator 31.

The timer circuit 21 supplies a timer signal C21 as the output thereof to one input terminal 16*a* of each switch control circuit 16 corresponding to each piezoelectric actuator 31.

The switch control circuit 16 inputs the switch control signal C1 supplied by the printing control circuit 15 and the timer signal C21 supplied by the timer circuit 21, makes logical products by the foregoing two signals, and outputs an analog switch control signal C3. The analog switch control signal C3 inputs to the control terminal 17*a* of each bidirectional analog switch 17 corresponding to each piezoelectric actuator 31.

The other construction is the same as the driving circuit 10 in FIG. 1, and the description will be omitted.

Figure 9:
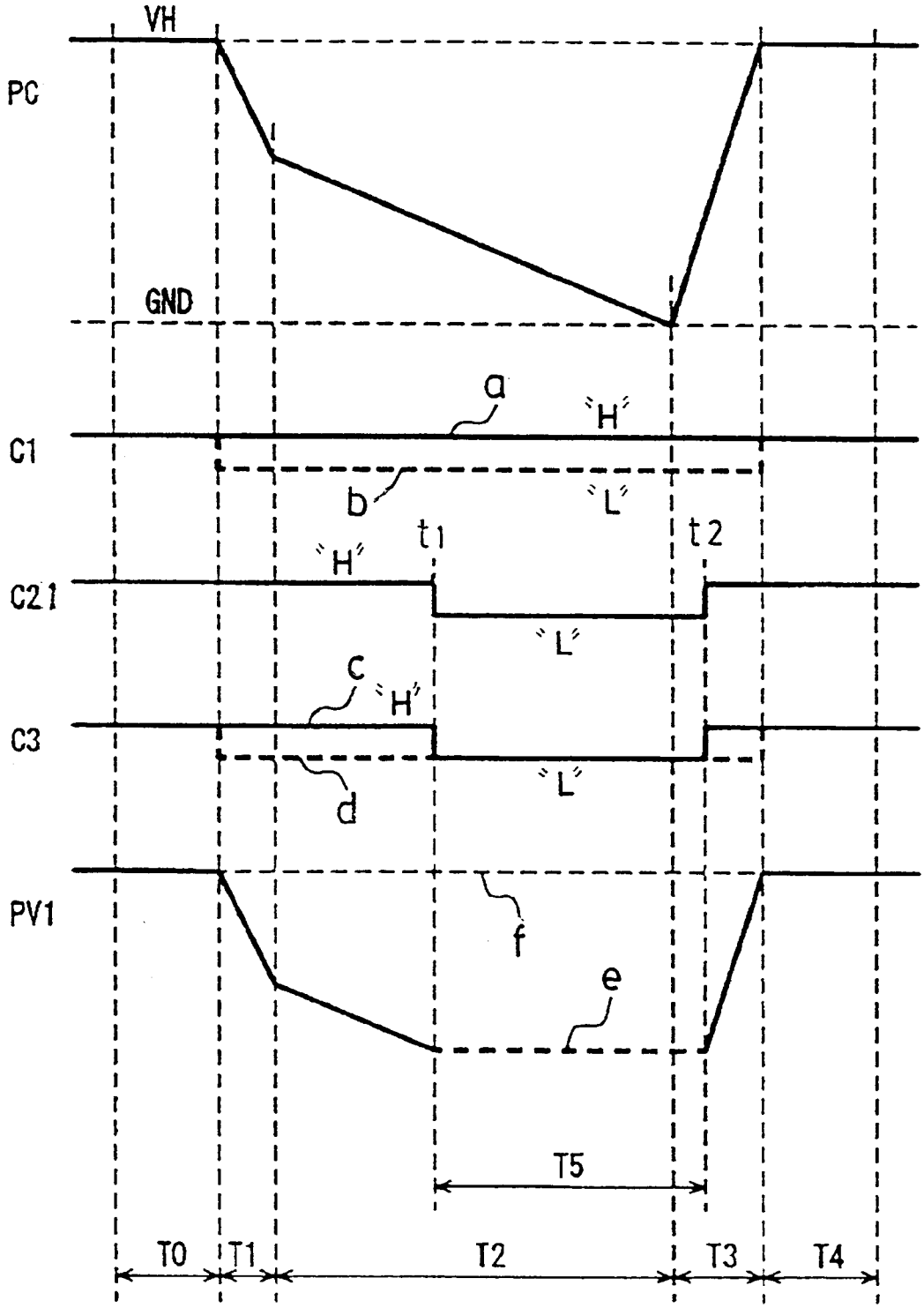
FIG. 9 is a chart showing respective signal waveforms for explaining the operation of the driving circuit shown in FIG. 8.

FIG. 9 shows waveforms of signals for explaining the operation of the driving circuit 20 in this second embodiment, which are similar to those in FIG. 2.

That is, this chart displays the driving voltage signal PC supplied by the common drive waveform generator 11, the switch control signal C1 supplied by the printing control circuit 15, the timer signal C21 supplied by the timer circuit 21, the analog switch control signal C3 supplied by the switch control circuit 16, and a terminal voltage PV1 generated at the second connector electrode 35 (see FIG. 3) of the piezoelectric actuator 31.

The abscissa in FIG. 9 is a time axis to show passage of time in the same manner as in FIG. 2, and it indicates one printing cycle. The vertical axis of ordinate appropriately indicates a voltage and a logical level. The period for one printing cycle consists, in the same manner as in FIG. 2, of the initial period T0, the first ink supply period T1, the second ink supply period T2, the ink discharge period T3, and the restoring period T4.

Next, the method of driving an ink-jet head by the driving circuit of the second embodiment according to the invention will be described with reference to FIG. 8 and FIG. 9.

Further, in order to simplify the description, only one piezoelectric actuator is focused on like the explanation of the method of driving in the first embodiment, and the method of driving this one will now be described.

First, the printing data processor circuit 18 outputs the printing control signal C0 containing printing data and an discharge instruction to the gradation data separation/accumulation circuit 13 and the printing control circuit 15. The gradation data separation/accumulation circuit 13 separates the gradation data from the printing control signal C0, stores the separated data temporarily in the memory incorporated therein, and outputs the printing gradation data QD with timing lined up to the timer circuit 21. The printing control circuit 15 judges the presence of the printing data and an ink discharge instruction signal from the printing control signal C0, and outputs the switch control signal C1 to the switch control circuit 16.

As shown in FIG. 9, the timer circuit 21 operates at the same time when the second ink supply period T2 starts and turns the timer signal C21 set to high level "H" in the initial period T0 into low level "L" when a first time t1 set in advance passes. And, the timer 21 operates at the same time when the ink discharge period T3 starts and it turns the timer signal C21 into high level "H" again when the second time t2 set in advance passes. Here, the first time t1 and the second time t2 are set in advance in the printing gradation data QD.

The first time t1 set in advance is a time in the second ink supply period T2, during which a voltage of the driving voltage signal PC is applied to the piezoelectric actuator 31 in order to obtain the gradation given by the printing gradation data QD. The second time t2 is a time in the ink discharge period T3, at which the driving voltage signal PC exceeds the voltage applied at the first time t1 in the reverse direction.

The timer circuit 21 in this embodiment is incorporated with a data table, in which the preset data for the first time t1 and the second time t2 corresponding to the printing gradation data QD are recorded. The preset data are read out by the printing gradation data QD for every printing cycle, whereby the first time t1 and the secondtime t2 are preset.

The switch control signal C1 supplied by the printing control circuit 15 is always in high level "H" during the initial period T0 and restoring period T4 as shown in FIG. 9. When the printing data is present, the switch control signal C1 is in high level "H" during the three periods of the first ink supply period T1, the second ink supply period T2, and the ink discharge period T3, as shown in FIG. 9 with a solid line a. When the printing data is not present, the switch control signal C1 is in low level "L" during the three periods of the first ink supply period T1, the second ink supply period T2, and the ink discharge period T3 as shown in FIG. 9 with a dotted line b.

The switch control circuit 16 outputs the analog switch control signal C3 being a logical product of the switch control signal C1 and the timer signal C21 to the control terminal 17*a* of the bidirectional analog switch 17.

The bidirectional analog switch 17 becomes conductive when the analog switch control signal C3 is in high level "H" as shown in FIG. 9 with a solid line c, and nonconductive when in low level "L" as shown with a dotted line d.

Therefore, when the printing data is present, the bidirectional analog switch 17 becomes nonconductive only while the timer signal C21 is in low level "L", and the driving voltage signal PC becomes nonconductive during the same period. Accordingly, the terminal voltage PV1 generated at the second connector electrode 35 of the piezoelectric actuator 31 holds during the same time the potential of the driving voltage signal PC immediately before being nonconductive as shown in FIG. 9 with a thick dotted line e.

When the printing data is not present, the bidirectional analog switch 17 becomes nonconductive during the three periods of the first ink supply period T1, the second ink supply period T2, and the ink discharge period T3, and the terminal voltage PV1 generated at the second connector electrode 35 of the piezoelectric actuator 31 holds a potential virtually equal to the potential when the power source voltage VH is applied in the initial period T0 through the whole periods, as shown in FIG. 9 with a thin dotted line f.

As clear from the description of the second embodiment, if the density of gradation data in printing data given by the printing data processor circuit 18 is low, the bidirectional analog switch 17 will become nonconductive when the driving voltage signal PC is high. Therefore, the volume of ink drawn in by deforming the piezoelectric actuator 31 and the ink chamber 36 becomes small, and accordingly, the volume of ink droplets discharged by the piezoelectric actuator 31 also becomes small.

On the contrary, if the density of a printing gradation data in the printing data is high, the bidirectional analog switch 17 will become nonconductive when the driving voltage signal PC is low. Therefore, the volume of ink drawn in by deforming the piezoelectric actuator 31 and the ink chamber 36 becomes large, and accordingly, the volume of ink droplets discharged becomes large.

In other words, in the second embodiment of the invention, the gradation control only needs to set the first time t1 long when making the gradation high (thick), and to set the first time t1 short when making the gradation low (thin).

It is natural to reduce leakage of charges from the piezoelectric actuator 31, or to maintain the insulation resistance as high as possible while the bidirectional analog switch 17 is nonconductive. However, assuming charge leakage due to dispersion on a production line, in the same manner as the first embodiment, the piezoelectric actuator 31 is charged in advance by applying a voltage almost equal to the power source voltage VH during the initial period T0 as a charging compensation period before the first ink supply period T1.

[Third Embodiment]

A method of driving an ink-jet head by the third embodiment according to the invention will now be described.

Figure 10:
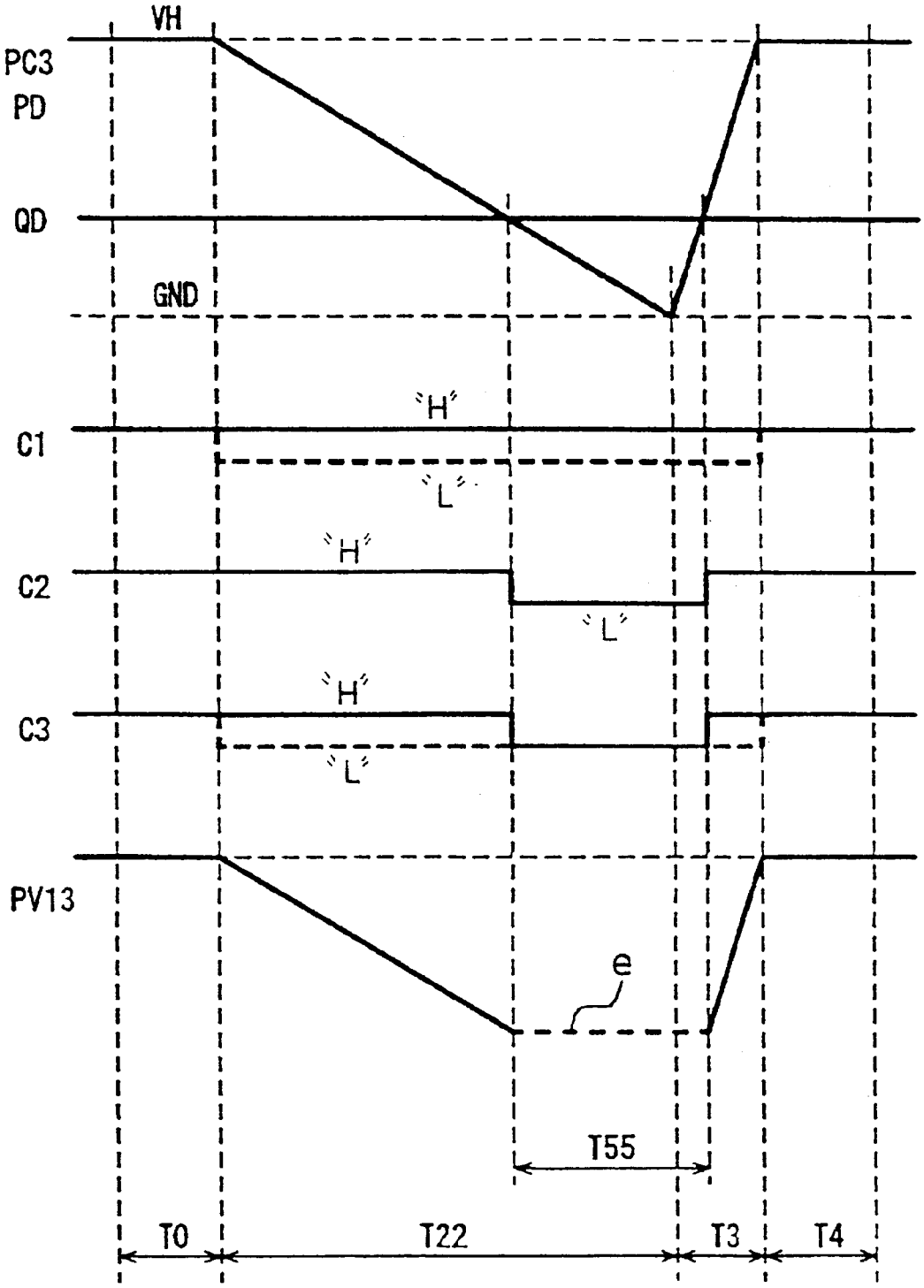
FIG. 10 is a chart showing respective signal waveforms for explaining the operation of an ink-jet head of a third embodiment according to the invention.

FIG. 10 is a chart showing signal waveforms similar to FIG. 2 for explaining the operation of an ink-jet head by the third embodiment according to the invention.

The driving method of the third embodiment is basically the same as that of the first embodiment, and hence it is explained with reference to the block diagram of FIG. 1 and the chart showing the waveform of FIG. 10.

That is, the driving voltage signal PC generated by the common drive waveform generator 11 of the driving circuit 10 used in the first embodiment is modified into a driving voltage signal PC3 shown in FIG. 10, and accompanying with this modification, the terminal voltage PV1 generated at the second connector electrode 35 of the piezoelectric actuator 31 is changed into a terminal voltage PV13 shown in FIG. 10.

The driving voltage signal PC3 employed in the third embodiment shown in FIG. 10 is such that the first ink supply period T1 in the driving voltage signal PC employed in the first embodiment is removed and a second ink supply period T22 during which the driving voltage signal PC3 is gently discharged starts immediately after the initial period T0.

More in detail, the driving voltage signal PC3 employed in the third embodiment consists of an initial voltage, ink supply voltage, ink discharge voltage, and restoring voltage.

The initial voltage is generated in the initial period T0 during which the piezoelectric actuator 31 is charged to be set to the initial state. The ink supply voltage is generated in the ink supply period T22 during which the piezoelectric actuator is gently discharged to supply ink into the ink chamber. The ink discharge voltage is generated in the ink discharge period T3 during which the piezoelectric actuator is rapidly charged to discharge ink in the ink chamber. The restoring voltage is generated in the restoring period T4 during which the state of the ink chamber is restored to the initial state.

The method of driving an ink-jet head by the third embodiment according to the invention is designed to discharge the piezoelectric actuator gently immediately from the end of the initial period T0 and to supply ink into the ink chamber gently during the ink supply period T22.

The data comparator circuit 14 shown in FIG. 1 compares the drive waveform data PD supplied by the analog/digital converter circuit 12 whereby the driving voltage signal PC3 is converted into digital data with the printing gradation data QD supplied by the gradation data separation/accumulation circuit 13.

The output of the data comparator circuit 14, namely, the comparison signal C2 becomes low level "L" when the drive waveform data PD is lower than the printing gradation data QD, and it becomes low level "L" during a period T55 in FIG. 10. The switch control circuit 16 makes a logical product by the comparison signal C2 and the switch control signal C1 supplied by the printing control circuit 15 and outputs the analog switch control signal C3.

The analog switch control signal C3 is in low level "L" during the period T55, and the bidirectional analog switch 17 becomes nonconductive. Since the driving voltage signal PC3 is cut off during the period T55, the terminal voltage PV13 generated at the second connector electrode 35 of the piezoelectric actuator 31 holds a potential of the driving voltage signal PC3 immediately before being cut off, by the charges stored in the piezoelectric actuator 31, as shown in FIG. 10 with a thick dotted line e.

In the driving method in the third embodiment, the piezoelectric actuator 31 is gently discharged only during the ink supply period T22 to supply ink into the ink chamber. Accordingly, it takes long to supply ink of necessary quantity into the ink chamber compared to the first embodiment. However, the natural vibration generated in the piezoelectric actuator and ink inside the ink chamber becomes significantly reduced compared to the first embodiment, which is advantageous.

The third embodiment of the invention can also be achieved by modifying the second embodiment in such a manner that the driving voltage signal PC generated by the common drive waveform generator 11 of the driving circuit 20 shown in FIG. 8 is changed into the driving voltage signal PC3 shown in FIG. 10, and the data relating to the first time and second time of the timer circuit 21 is changed.

And, the natural vibration generated in the piezoelectric actuator and ink inside the ink chamber can be reduced and the volume of ink droplets discharged can be controlled, and gradation of a printing image can stabilized.

[Supplemental Descriptions of the First Through Third Embodiments]

It is possible to damp free vibrations generated in the piezoelectric actuator and ink inside the ink chamber in the first through third embodiments of the invention by such an arrangement that the common drive waveform generator generating the driving voltage signal PC or PC3 employs a constant current circuit capable of absorbing a large amount of constant current during the first ink supply period T1, employs a constant current circuit absorbing a smaller amount of constant current during the second ink supply period T2 or the ink supply period T22 than that during the first ink supply period T1, and thereby discharging the piezoelectric actuator, and employs a constant current circuit capable of supplying a large amount of constant current to charge the piezoelectric actuator during the ink discharge period T3. In consequence, ink droplets of virtually constant speed can be obtained independently of the size of ink droplets, and stable discharge of ink droplets becomes possible.

Further, a timing of ink discharge can be acquired virtually constant regardless of a gradation level, since the ink discharge period T3 is comparably short.

In each foregoing embodiment of the invention, a high voltage close to the power source voltage VH is applied as the initial voltage in the initial state T0 to store charges into the piezoelectric actuator. And, the first ink supply voltage during the first ink supply period T1, the second ink supply voltage during the second ink supply period T2, or in the third embodiment, the ink supply voltage during the ink supply period T22 is approaches to the ground level to be applied. Thereby, the charges stored in the piezoelectric actuator are discharged, and further in the ink discharge period T3, these ink supply voltages are designed to be restored to the high voltage.

However, depending on a driving mode of a piezoelectric actuator employed for an ink-jet head, the direction for applying the drive voltage can be reversed against the direction applied in the foregoing embodiments. Namely, it is conceivable that the initial voltage in the initial state T0 is set to the ground level and the voltage is applied so as to supply ink. In this case, it is natural that the data value of the printing gradation data is set so as to become high when the printing density is high, and the data value is set so as to become low when the printing density is low.

If the direction or polarity for applying voltage to the piezoelectric actuator is different from the driving circuit and method of the invention, it is clearly understood that such variations and modifications will fall within the scope of the invention, as long as the object and function are consistent with the true spirit of the invention.

[Fourth Embodiment]

Next, a circuit for driving an ink-jet head and a method of driving the same of the fourth embodiment according to the invention will be described.

Figure 11:
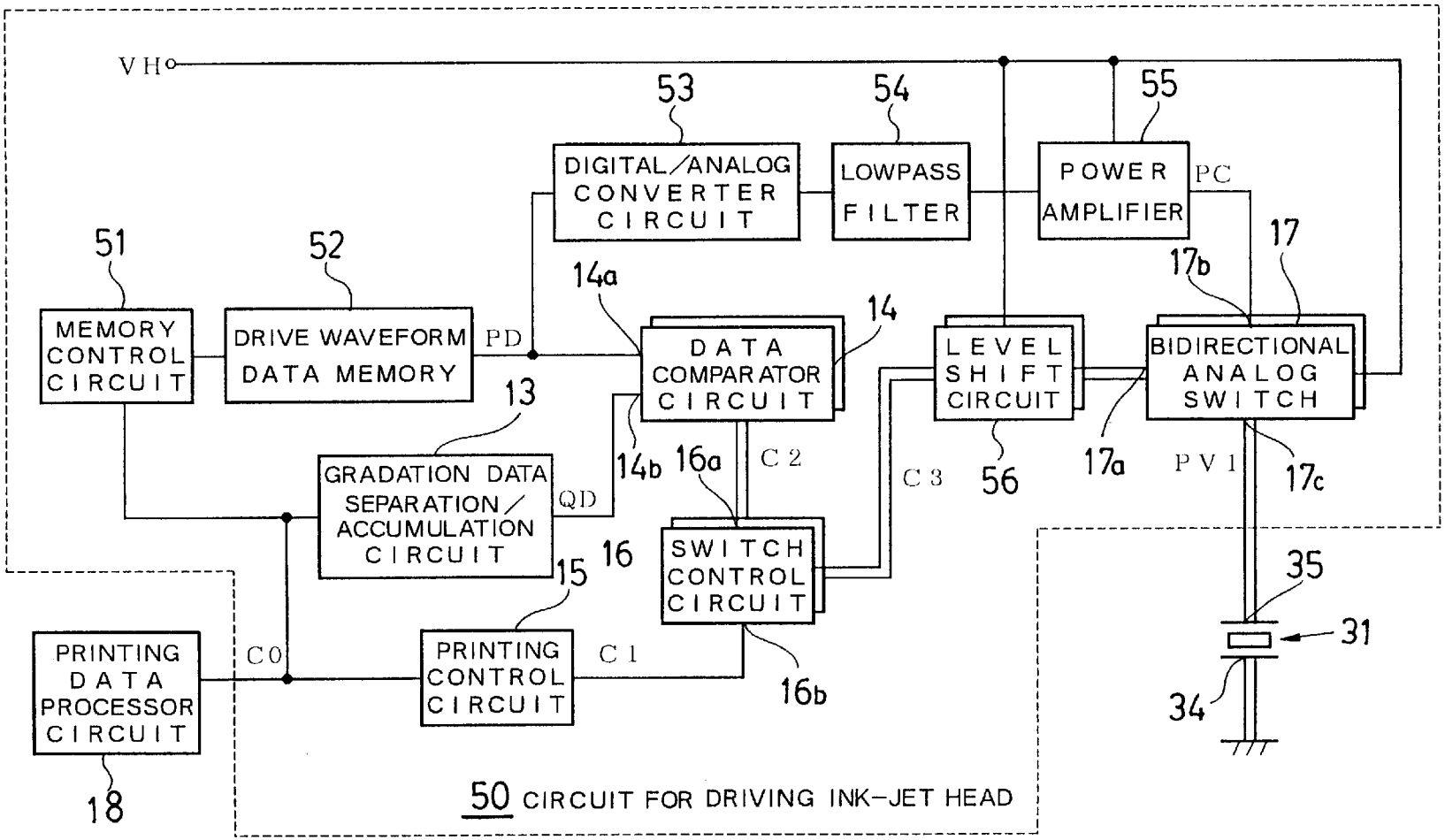
FIG. 11 is a block diagram showing a construction of a circuit for driving an ink-jet head of a fourth embodiment according to the invention.

FIG. 11 is a block diagram showing a construction of the circuit for driving an ink-jet head of the fourth embodiment according to the invention, including the printing data processor circuit 18 and the piezoelectric actuator 31. In FIG. 11, the parts corresponding to those in FIG. 1 and FIG. 2 are given the same symbols.

The printing data processor circuit 18 is incorporated in a printer body, in which a reference clock, a timing instruction signal, and a picture image data to be printed transmitted from a host computer are processed to output a printing control signal C0 including the reference clock, the timing instruction signal, a gradation data, and an ink discharge instruction signal.

A circuit 50 for driving an ink-jet head comprises a drive waveform data memory 52 that decomposes the driving voltage signal PC shown in FIG. 5 in a unit of time and converts into digital data and stores the digital data as the drive waveform data PD, and a memory control circuit 51 that sequentially supplies an address data of the drive waveform data memory 52 with a constant time interval using the timing instruction signal supplied by the printing data processor circuit 18 as a trigger.

The circuit 50 further comprises a digital/analog converter circuit 53 that converts the drive waveform data PD supplied by the drive waveform data memory 52 into an analog signal as the output, and a lowpass filter 54 that removes high frequency noise components from the analog signal supplied by the digital/analog converter circuit 53 and smoothes the analog signal.

The circuit 50 further comprises a power amplifier 55 that amplifies the analog signal supplied by the lowpass filter 54 to a potential level of the power source voltage VH as the driving voltage signal PC to drive the piezoelectric actuator 31, and also amplifies the current for driving all the piezoelectric actuators.

Further, the circuit 50 comprises, in the same manner as the driving circuit 10 in the first embodiment shown in FIG. 1, the gradation data separation/accumulation circuit 13, data comparator circuit 14, printing control circuit 15, switch control circuit 16, and bidirectional analog switch 17, and a level shift circuit 56 interposed between the switch control circuit 16 and the bidirectional analog switch 17.

The gradation data separation/accumulation circuit 13 separates the gradation data of each of the piezoelectric actuators 31 contained in the printing control signal C0 and temporarily stores as digital data, and outputs the printing gradation data QD synchronously with the timing instruction signal.

The data comparator circuit 14 compares a potential level of the printing gradation data QD with that of the drive waveform data PD input from the drive waveform data memory 52, and outputs the comparison signal C2 representing the result of the comparison.

The printing control circuit 15 judges the presence of an ink discharge instruction signal for each nozzle contained in the printing control signal C0 to output the switch control signal C1.

The switch control circuit 16 makes a logical product by the comparison signal C2 from the data comparator circuit 14 and the switch control signal C1 from the printing control circuit 15, and outputs as the analog switch control signal C3.

The level shift circuit 56 boosts an output level of the analog switch control signal C3 to the potential level of the power source voltage VH to drive the piezoelectric actuator 31.

The bidirectional analog switch 17 controls the driving voltage signal PC supplied from the power amplifier 55 by the boosted analog switch control signal C3 to apply the driving voltage signal PC to the piezoelectric actuator 31.

In the circuit 50 for driving an ink-jet head shown in FIG. 11, the memory control circuit 51, drive waveform data memory 52, digital/analog converter circuit 53, lowpass filter 54, power amplifier 55, gradation data separation/accumulation circuit 13, and printing control circuit 15 are commonly used for all of the piezoelectric actuators 31 provided in the ink-jet head.

On the other hand, the data comparator circuit 14, switch control circuit 16, level shift circuit 56 and bidirectional analog switch 17 each are provided individually for each piezoelectric actuator 31 (these circuit blocks and connection lines are shown with double lines).

And, the power amplifier 55, level shift circuit 56, and bidirectional analog switch 17 are supplied with the power source voltage VH to drive the piezoelectric actuator 31, and the other circuits are supplied with a standard logic voltage (5 V in general).

Figure 12:
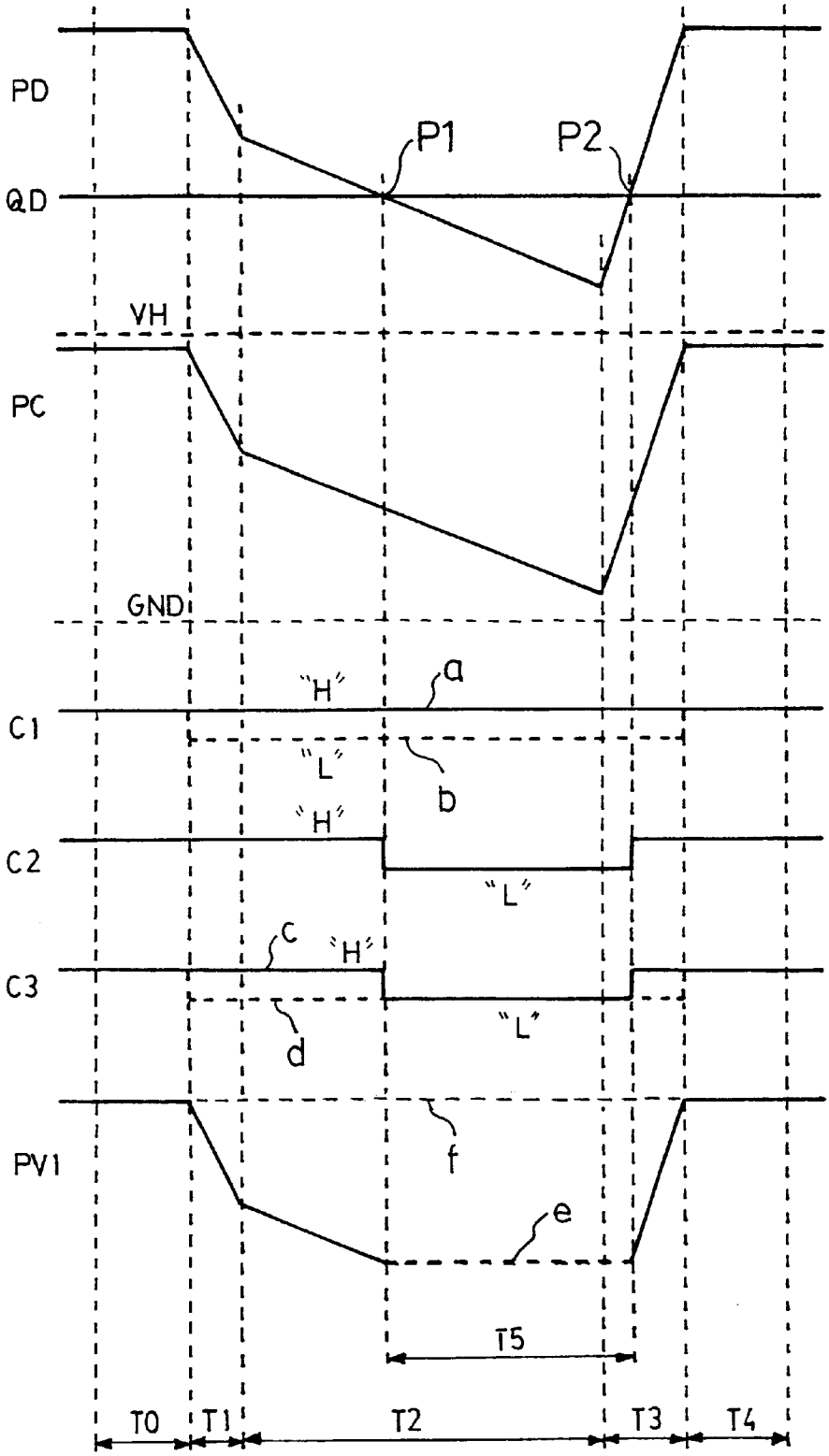
FIG. 12 is a chart showing respective signal waveforms for explaining the operation of the driving circuit shown in FIG. 11.

FIG. 12 shows signal waveforms similar to FIG. 2, which explain the operation of the circuit for driving an ink-jet head of the fourth embodiment.

Namely, the waveforms in FIG. 12 include the drive waveform data PD supplied by the drive waveform data memory 52, driving voltage signal PC supplied by the power amplifier 55 after the digital/analog converter circuit 53 converts the drive waveform data PD into an analog signal, printing gradation data QD supplied by the gradation data separation/accumulation circuit 13, switch control signal C1 supplied by the printing control circuit 15, comparison signal C2 supplied by the data comparator circuit 14, analog switch control signal C3 supplied by the switch control circuit 16, and terminal voltage PV1 generated at the second connector electrode of the piezoelectric actuator 31.

The drive waveform data PD shown in FIG. 12 is digital data obtained by decomposing the analog driving voltage signal PC shown in FIG. 5 in a unit of time, and the magnitude of the data values is visually displayed on the vertical axis of ordinate. The printing gradation data QD is superimposed on the drive waveform data PD for comparison with the drive waveform data PD.

The driving voltage signal PC is equivalent to the driving voltage signal PC shown in FIG. 5, and it is made such that the digital/analog converter circuit 53 converts the drive waveform data PD into an analog signal and the power amplifier 55 amplifies the analog signal to an appropriate power enough to drive all of the actuators 31.

The axis of abscissas for waveforms shown in FIG. 12 is a time axis to show a passage of time, which indicates a time passage equivalent to a process time necessary for discharging one ink droplet, namely, one printing cycle. The axis of ordinate shows the magnitude of digital values, voltages, or logical levels appropriately.

The printing cycle shown in FIG. 12 consists of the initial period T0, first ink supply period T1, second ink supply period T2, discharge period T3, and restoring period T4.

Next, the method of driving an ink-jet head according to the fourth embodiment of the invention will be described with reference to FIG. 11 and FIG. 12.

The driving method according to this embodiment is originally intended to drive multiple piezoelectric actuators provided in an ink-jet head into different operations in correspondence with gradations of picture images to be printed. However, in order to simplify the description, only one piezoelectric actuator is focused on, and the method of driving this one will now be described.

First, the printing data processor circuit 18 outputs the printing control signal C0 including the reference clock, a timing instruction signal, a gradation data, and an ink discharge instruction signal to the memory control circuit 51, gradation data separation/accumulation circuit 13, and a printing control circuit 15.

The gradation data separation/accumulation circuit 13 separates the gradation data from the printing control signal C0 to temporarily store it in a memory incorporated therein, and outputs the printing gradation data QD to the input terminal 14*b* of the data comparator circuit 14 during the initial period T0, synchronously with the timing instruction signal supplied by the printing data processor circuit 18.

The printing gradation data QD is, as to the ink-jet head 30 employed in this embodiment shown in FIG. 3 and FIG. 4, digital data equivalent to an analog voltage closer to the ground level as the printing gradation becomes thicker and equivalent to an analog voltage closer to the power source voltage VH as the printing gradation becomes thinner.

The printing control circuit 15 judges the presence of the ink discharge instruction signal for each of the nozzles from the printing control signal C0, and outputs the switch control signal C1 consisting of logical levels of high "H" or low "L" to the input terminal 16*b* of the switch control circuit 16 synchronously with the timing instruction signal during the three periods of the first ink supply period T1, second ink supply period T2, and ink discharge period T3.

The switch control signal C1 is always in high level "H" during the two periods of the initial period T0 and the restoring period T4 regardless of the presence of the ink discharge instruction signal for each of the nozzles. During the three periods of the first ink supply period T1, second ink supply period T2, and ink discharge period T3, the switch control signal C1 becomes high level "H" as shown in FIG. 12 with a solid line a when the ink discharge instruction signal for each of the nozzles is present, and it becomes low level "L" as shown in FIG. 12 with a dotted line b when the ink discharge instruction signal for each of the nozzles is not present.

The memory control circuit 51 sequentially generates an address data for accessing the drive waveform data memory 52 using the timing instruction signal supplied by the printing data processor circuit 18 as the trigger. The drive waveform data memory 52 sequentially reads out the drive waveform data PD, which is supplied to the digital/analog converter circuit 53 and the input terminal 14*a* of the data comparator circuit 14.

The digital/analog converter circuit 53 converts the drive waveform data PD into an analog signal sequentially, and outputs a drive waveform signal. Since the noise of the high frequency components generated when converted into the analog signal are superimposed on the drive waveform signal, the lowpass filter 54 removes the noise of the high frequency components from the drive waveform signal as needed. The power amplifier 55 amplifies the drive waveform signal to the driving voltage signal PC capable of driving all of the piezoelectric actuators.

The data comparator circuit 14 compares the drive waveform data PD with the printing gradation data QD, and outputs the comparison signal C2 of high level "H" when the value of the drive waveform data PD is larger than that of the printing gradation data QD and outputs the comparison signal C2 of low level "L" when the value of the drive waveform data PD is smaller.

Therefore, the comparison signal C2 shown in FIG. 12 is in low level "L" only during a cutoff period T5 from a first intersection P1 at which the drive waveform data PD goes lower in the digital value than the printing gradation data QD to a second intersection P2 at which the drive waveform data PD goes higher in the digital value than the printing gradation data QD.

The switch control circuit 16 outputs the analog switch control signal C3 being a logical product by the switch control signal C1 and the comparison signal C2. The level shift circuit boosts the analog switch control signal C3, which is supplied to the control terminal 17*a* of the bidirectional analog switch 17.

The bidirectional analog switch 17 makes the circuit conductive between the input output terminal 17*b* and the other input output terminal 17*c* when the control terminal 17*a* is in high level, and it makes the circuit nonconductive between both the input output terminals 17*b* and 17*c* when the control terminal 17*a* is in low level.

Therefore, when the ink discharge instruction signal to each of the nozzles is present, the analog switch control signal C3 goes low level "L" only during the cutoff period T5 as shown in FIG. 12 with a solid line c, and the bidirectional analog switch 17 becomes nonconductive only during the period. Accordingly, the terminal voltage PV1 generated at the second connector electrode 35 of the piezoelectric actuator 31 holds a potential of the driving voltage signal PC immediately before being cut off as shown in FIG. 12 with a thick dotted line e by the charges stored in the piezoelectric actuator 31, as the driving voltage signal PC is cut off only during the cutoff period T5.

On the contrary, when the ink discharge instruction signal to each of the nozzles is not present, the analog switch control signal C3 goes to low level "L" through the three periods of the first ink supply period T1, second ink supply period T2, and ink discharge period T3 as shown in FIG. 12 with a dotted line d, and the bidirectional analog switch 17 becomes nonconductive during the three periods. Accordingly, the terminal voltage PV1 generated at the second connector electrode 35 of the piezoelectric actuator 31 holds a potential virtually equal to the power source voltage VH through the first ink supply period T1, second ink supply period T2, and ink discharge period T3 as shown in FIG. 12 with a thin dotted line f.

As described previously with reference to FIG. 7, varying the second ink supply period T2 will control the diameter of ink droplets discharged and the diameter of picture elements on a printing paper, thus adding gradation of density in a picture element on picture images to be printed. And, according to the method of driving an ink-jet head of the fourth embodiment, to vary the period T5 is possible. Accordingly, varying the cutoff period T5 will control the diameter of ink droplets so that the gradation of density can be added on picture images.

As clear from the description of the fourth embodiment, if the density of gradation data in printing data given by the printing data processor circuit 18 is low, the cutoff period T5 will be prolonged, and the bidirectional analog switch 17 will become nonconductive when the driving voltage signal PC is high. Therefore, the deformation of the piezoelectric actuator 31 becomes small and the volume of ink drawn in by deforming the ink chamber 36 becomes small, and accordingly, the volume of ink droplets discharged by the piezoelectric actuator 31 also becomes small.

On the contrary, if the density of a gradation data in a printing data is high, the cutoff period T5 will be shortened, and the bidirectional analog switch 17 will become nonconductive when the driving voltage signal PC is low. Therefore, the deformation of the piezoelectric actuator 31 becomes large and the volume of ink drawn in by deforming the ink chamber 36 becomes large, and accordingly, the volume of ink droplets discharged by the piezoelectric actuator 31 becomes large.

Therefore, when the value of the printing gradation data QD is minimum, the voltage of all voltage waveforms of the driving voltage signal PC is applied to the piezoelectric actuator 31, and the volume of ink droplets discharged by the piezoelectric actuator 31 becomes maximum.

In other words, in the fourth embodiment of the invention, the gradation control only needs to set the value of the printing gradation data QD low when making the gradation high (thick), and to set the value of the printing gradation data QD high when making the gradation low (thin).

It is natural to reduce leakage of charges from the piezoelectric actuator 31, or to maintain the insulation resistance as high as possible while the bidirectional analog switch 17 is nonconductive. However, assuming charge leakage due to dispersion on a production line, also in the fourth embodiment, the piezoelectric actuator 31 is charged in advance by applying a voltage almost equal to the power source voltage VH during the initial period T0 as a charging compensation period before the first ink supply period T1.

In this fourth embodiment, the power amplifier 55 supplying the driving voltage signal PC absorbs a large amount of discharge current from the piezoelectric actuator 31 during the first ink supply period T1 in FIG. 12, and the power amplifier 55 absorbs a smaller amount of discharge current from the piezoelectric actuator 31 during the second ink supply period T2 than that during the first ink supply period T1.

And, during the ink discharge period T3, the power amplifier 55 supplies a large amount of current into the piezoelectric actuator 31 to rapidly charge the piezoelectric actuator 31.

In the first ink supply period T1, second ink supply period T2, and ink discharge period T3, or at least in the second ink supply period T2, setting the data in the drive waveform data memory 52 so that the terminal voltage PV1 generated at the second connector electrode 35 of the piezoelectric actuator 31 varies linearly will make the discharge current or the charge current from or to the piezoelectric actuator 31 virtually constant. Thereby, free vibrations generated in the piezoelectric actuator and ink inside the ink chamber can be damped, ink droplets with a virtually constant speed can be obtained regardless of the size of the ink droplets, and therefore, discharge of ink droplets of stable quality becomes possible.

Further, the ink discharge timing is almost unified regardless of the gradation density, since the voltage rapidly varies in a comparably short time in the ink discharge period T3.

[Fifth Embodiment]

Next, a circuit for driving an ink-jet head of the fifth embodiment of the invention and a method of driving an ink-jet head applying the driving circuit will be described.

Figure 13:
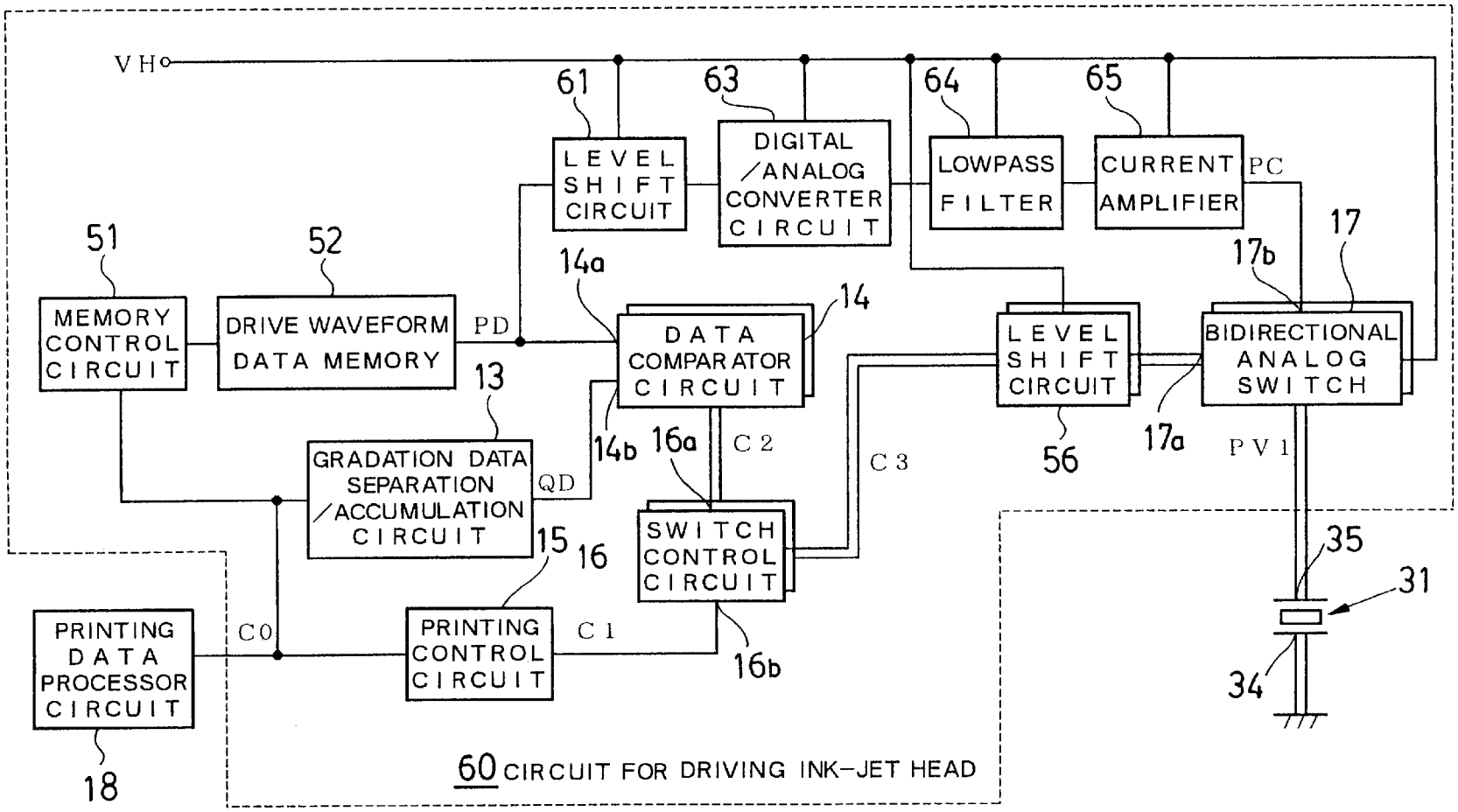
FIG. 13 is a block diagram showing a construction of a circuit for driving an ink-jet head of a fifth embodiment according to the invention.
Figure 14:
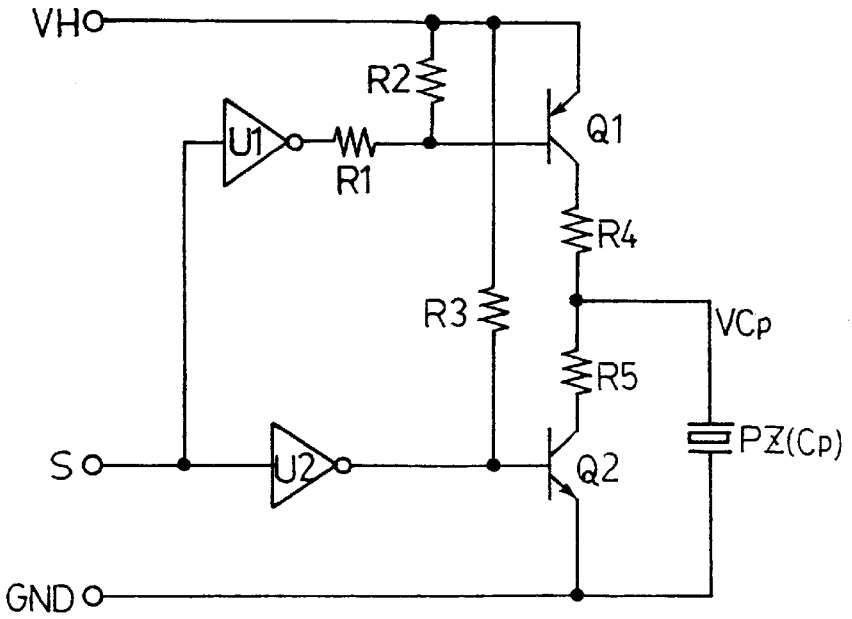
FIG. 14 PRIOR ART
FIG. 14 is an example of a conventional circuit for driving an ink-jet head.
Figure 15:
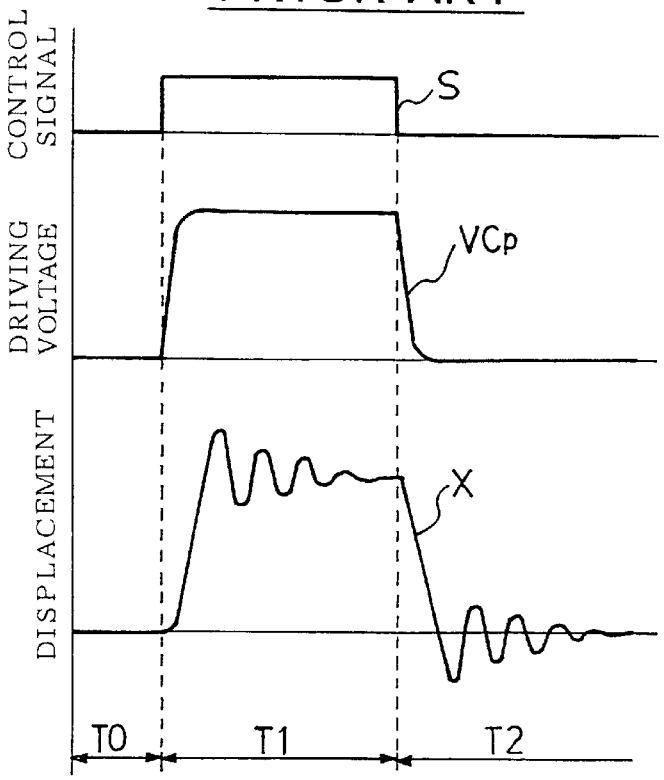
FIG. 15 PRIOR ART
FIG. 15 is a chart showing a waveform of a control signal and a drive voltage signal, and a waveform of displacement of the piezoelectric actuator in the conventional example.

FIG. 13 is a block diagram showing a construction of a circuit for driving an ink-jet head of the fifth embodiment of the invention, and the same parts as in FIG. 11 are given the same symbols, of which explanations will be omitted.

A circuit 60 for driving an ink-jet head shown in FIG. 13 has the virtually same construction as the circuit 50 for driving an ink-jet head of the fourth embodiment shown in FIG. 11.

However, the digital/analog conveter 53 and the lowpass filter 54 in FIG. 11 are replaced by a digital/analog converter circuit 63 and a lowpass filter 64 that operate by the power source voltage VH to drive the piezoelectric actuator 31.

Further, between the drive waveform data memory 52 and the digital/analog converter circuit 63, a level shift circuit 61 is interposed which boosts an output level of the drive waveform data PD to a potential of the power source voltage VH to drive the piezoelectric actuator 31 and, a current amplifier 65 amplifying only current is incorporated to replace the power amplifier 55 that amplifies both the current and voltage.

Thus, in the fifth embodiment, a comparably simple circuit as the level shift circuit 61 placed before the current amplifier 65 boosts the drive waveform data of a digital data. Further, the current amplifier 65 can be designed with a simple circuit compared to such an analog circuit amplifying both the voltage and current as the power amplifier 55 of the fourth embodiment, and therefore, the scale of the whole driving circuit 60 can be reduced.

A method of driving an ink-jet head according to the fifth embodiment does not basically differ from the foregoing fourth embodiment, and it is the same except that the digital/analog conveter 53 and the lowpass filter 54 operate by the power source voltage VH to drive the piezoelectric actuator 31, and hence the description will be omitted.

As for the driving voltage signal PC in the fifth embodiment, in the same manner as in the fourth embodiment, it is possible to set the data in the drive waveform data memory 52 so that the drive voltage supplied to the piezoelectric actuator 31 can damp free vibrations generated in the piezoelectric actuator 31 and ink inside the ink chamber in the first ink supply period T1, second ink supply period T2, and ink discharge period T3. Thereby, ink droplets with a virtually constant speed can be obtained regardless of the size of the ink droplets, and naturally discharge of ink droplets of stable quality becomes possible.

Further, ink discharge timing is almost unified regardless of the gradation density, since the ink discharge period T3 is a comparably short time, which is the same as in the fourth embodiment.

[Supplementary Description]

The foregoing lowpass filters 54, 64 employed in the fourth and fifth embodiment of the invention are to remove high frequency noise components contained in the analog signals supplied by the digital/analog converter circuit 53, 63 and to smooth the analog signals. Accordingly, in case where high frequency noise components contained in the drive waveform signal do not give any influence on driving the piezoelectric actuator 31, and further, do not give influences on the other circuits, the lowpass filter can be omitted.

Furthermore, in the circuit for driving an ink-jet head according to the fourth and fifth embodiments of the invention, although circuit groups that operate by the standard logic voltage and the other circuit groups that operate by a higher voltage of the power source voltage VH may be allocated separately, obviously integrating these two circuit groups into one semiconductor integrated circuit can make a smaller ink-jet printer.

Further, in the circuits and methods for driving an ink-jet head in each of the above mentioned embodiments, the piezoelectric actuator that deforms in the perpendicular direction (d33 direction) as shown in FIG. 3 and FIG. 4 has been used for the ink-jet head. However, this invention can be applied to all types of ink-jet heads that discharge ink as a driving circuit for controlling the drive waveforms of the ink-jet heads thereof by expanding and shrinking an ink chamber, using a stretching function that a piezoelectric actuator exhibits when a voltage is applied thereto.

Still, according to the circuit and method for driving an ink-jet head of the fourth and fifth embodiment, replacing the drive waveform data of a digital data stored in the drive waveform data memory with different data can easily acquire a different drive waveform signal. Thus, the most appropriate drive voltage waveform for the ink-jet head used can be set without modifying the drive circuit, leading to a significant effect of the invention.

[Industrial Applicability]

As described hereinabove, according to the circuit and method of driving an ink-jet head of the invention, the volume of ink droplets discharged from a nozzle can be controlled to comply with a desired picture gradation in accordance with a gradation data. Moreover, ink droplets with a constant speed can be obtained regardless of the sizes of ink droplets, and ink droplets can be discharged stably with a virtually constant discharge time and a quick cycle.

Accordingly, in printing a tone image having a density gradation as a photograph by the dither method or density pattern method that is used for the gradation control in a general ink-jet printer, a stable printing quality can be obtained without extremely lowering the density (resolution) of a picture element. Therefore, a picture image with a density gradation such as a full-color picture can be printed with a high resolution and a high quality.

Further, according to the invention, free vibrations generated in the piezoelectric actuator and ink inside the ink chamber are damped more rapidly, a long period has been common problem in an usual ink-jet head of the piezoelectric type, thereby avoiding forming unstable ink droplets at discharge such as being split or being atomized, reducing a time for the ink chamber to absorb ink inside or a time for free vibrations generated in the piezoelectric actuator and ink inside the ink chamber to be damped, and discharging ink in a shorter time so that printing speed can be increased.

Accordingly, the invention is applicable to various types of ink-jet printers provided with ink-jet heads using piezoelectric actuators, thus expanding the application.

What is claimed is:

1. A circuit for driving an ink-jet head comprising:

a common driving waveform generation circuit for generating a driving voltage signal for driving a piezoelectric actuator of the ink-jet head;

an analog/digital converter circuit for converting the driving voltage signal into driving waveform data serving as digital data;

a gradation data separation/accumulation circuit for separating printing gradation data contained in printing data therefrom, accumulating therein the separated printing gradation data temporarily, and outputting the separated printing gradation data at a predetermined timing;

a comparator circuit for comparing the driving waveform data with the printing gradation data and outputting the result of comparison as a comparison signal;

a printing control circuit for outputting presence of an ink discharge instruction signal contained in the printing data as a switch control signal;

a switch control circuit for making a logical product between the comparison signal and the switch control signal, and outputting the logical product as an analog switch control signal; and a bidirectional analog switch for controlling conductivity of the driving voltage signal so as to drive the piezoelectric actuator in accordance with the analog switch control signal.

2. A circuit for driving an ink-jet head comprising:

a common driving waveform generation circuit for generating a driving voltage signal for driving a piezoelectric actuator of the ink-jet head;

a gradation data separation/accumulation circuit for separating printing gradation data contained in printing data therefrom, accumulating therein the separated printing gradation data temporarily, and outputting the separated printing gradation data at a predetermined timing;

a timer circuit for outputting a timer signal, said timer signal being changed in a binary level within a time set thereby in accordance with the printing gradation data;

a printing control circuit for outputting a switch control signal upon judgment of presence of an ink discharge instruction signal contained in the printing data;

a switch control circuit for making a logical product by the timer signal and the switch control signal, and outputting the logical product as an analog switch control signal; and a bidirectional analog switch for controlling conductivity of the driving voltage signal so as to drive the piezoelectric actuator in accordance with the analog switch control signal.

3. A method of driving an ink-jet head comprising the steps of:

generating a driving voltage signal for driving a piezoelectric actuator of the ink-jet head;

converting the driving voltage signal into driving waveform data serving as digital data;

separating printing gradation data contained in printing data, accumulating the separated printing gradation data temporarily, and outputting a signal representing the separated gradation data at a predetermined timing;

comparing the driving waveform data with the printing gradation data, and outputting a result of comparison as comparison signal;

outputting a switch control signal upon judgment of presence of an ink discharge instruction signal contained in the printing data;

making a logical product by the comparison signal and the switch control signal, and outputting the logical product as an analog switch control signal; and controlling a bidirectional analog switch in accordance with the analog switch control signal, thereby controlling conductivity of the driving voltage signa for driving the piezoelectric actuator so that an ink droplet discharged from the ink-jet head is adjusted in accordance with a signal representing the printing gradation data.

4. A method of driving an ink-jet head comprising the steps of:

generating a driving voltage signal for driving a piezoelectric actuator of the ink-jet head;

separating printing gradation data contained in printing data, accumulating the separated printing gradation data temporarily, and outputting a signal representing the separated gradation data at a predetermined timing;

outputting a timer signal, said timer signal being changed in a binary level within a time set by a timer in accordance with the signal representing the separate gradation data;

outputting a switch control signal upon judgment of presence of an ink discharge instruction signal contained in the printing data;

making a logical product by the timer signal and the switch control signal, and outputting the logical product as an analog switch control signal; and controlling a bidirectional analog switch in accordance with the analog switch control signal, thereby controlling conductivity of the driving voltage signal for driving the piezoelectric actuator so that an ink droplet discharged from the ink-jet head is adjusted in accordance with a signal representing the printing gradation data.

5. A method of driving an ink-jet head according to claim 3, further comprising the steps of:

generating a voltage signal as the driving voltage signal comprising an initial voltage generated in an initial period for initializing an ink chamber of the ink-jet head, a first ink supply voltage which rapidly changes with respect to time, said time occurring during a first ink supply period for rapidly supplying ink to the ink chamber, a second ink supply voltage which gently changes with respect to time, said time occurring during a second ink supply period for slowly supplying ink to the ink chamber, an ink discharge voltage which rapidly changes with respect to time in a direction opposite to the first and second ink supply voltages, said time occurring during an ink discharge period for rapidly discharging the ink from the ink chamber, and a restoring voltage which is generated during a restoring period for restoring the ink chamber to its initial state;

comparing the driving waveform data converted from the driving voltage signals into digital data with the printing gradation data, reversing the comparison signal at a point where the driving waveform data first crosses the printing gradation data, and then reversing the comparison signal again at the point where the driving waveform data crosses the printing gradation data; and permitting the bidirectional analog switch to be conductive except in a period during which comparison signal is first reversed, thereby supplying the driving voltage signal to the piezoelectric actuator.

6. A method of driving an ink-jet head according to claim 3, further comprising the steps of:

generating a voltage signal as the driving voltage signal comprising an initial voltage generated during an initial period for initializing an ink chamber of the ink-jet head, an ink supply voltage which gently changes with respect to time, said time occurring during an ink supply period for slowly supplying ink to the ink chamber, an ink discharge voltage which rapidly changes with respect to time in a direction opposite to the ink supply voltage, said time occurring during an ink discharge period for rapidly discharging the ink from the ink chamber, and a restoring voltage which is generated during a restoring period for restoring the ink chamber to its initial state;

comparing the driving waveform data converted from the driving voltage signals into digital data with the printing gradation data, reversing the comparison signal at a point where the driving waveform data first crosses the printing gradation data, and then reversing the comparison signal again at the point where the driving waveform data crosses the printing gradation data; and permitting a bidirectional analog switch to be conductive except in a period during which the comparison signal is first reversed, thereby supplying the driving voltage signal to the piezoelectric actuator.

7. A method of driving an ink-jet head according to claim 4, further comprising the steps of:

generating a voltage signal as the driving voltage signal comprising an initial voltage generated in an initial period for initializing an ink chamber of the ink-jet head, a first ink supply voltage which rapidly changes with respect to time, said time occurring during a first ink supply period for rapidly supplying ink to the ink chamber, a second ink supply voltage which gently changes with respect to time, said time occurring during a second ink supply period for slowly supplying ink to the ink chamber, an ink discharge voltage which rapidly changes with respect to time in a direction opposite to the first and second ink supply voltages, said time occurring during an ink discharge period for rapidly discharging the ink from the ink chamber, and a restoring voltage which is generated during a restoring period for restoring the ink chamber to its initial state;

operating a timer circuit which can be set with time in accordance with the printing gradation data simultaneously with starting of the second ink supply period, thereby reversing a timer signal within the set time, and thereafter operating the timer circuit simultaneously with starting of the ink discharge period, thereby reversing the timer signal again within time set differently from the set time; and permitting a bidirectional analog switch to be conductive except in a period during which the timer signal is first reversed, thereby supplying the driving voltage signal to the piezoelectric actuator.

8. A method of driving an ink-jet head according to claim 4, further comprising the steps of:

generating a voltage signal as the driving voltage signal comprising an initial voltage generated during an initial period for initializing an ink chamber of the ink-jet head, an ink supply voltage which gently changes with respect to time, said time occurring during an ink supply period for slowly supplying ink to the ink chamber, an ink discharge voltage which rapidly changes with respect to time in a direction opposite to the ink supply voltage, said time occurring during an ink discharge period for rapidly discharging the ink from the ink chamber, and a restoring voltage which is generated during a restoring period for restoring the ink chamber to its initial state;

operating a timer circuit which can be set with time in accordance with the printing gradation data simultaneously with starting of the ink supply period, thereby reversing a timer signal within the set time, and thereafter operating the timer circuit simultaneously with starting of the ink discharge period, thereby reversing the timer signal again within time set differently from the set time; and permitting a bidirectional analog switch to be conductive except in a period during which the timer signal is first reversed, thereby supplying the driving voltage signal to the piezoelectric actuator.

9. A circuit for driving an ink-jet head comprising:

a driving waveform data memory for accumulating digital data converted from driving waveform data obtained by dividing a driving voltage signal for driving a piezoelectric actuator of the ink-jet head by a time unit;

a memory control circuit for sequentially outputting address data in the driving waveform data memory at a predetermined time interval;

a digital/analog converter circuit for converting the driving waveform data outputted from the driving waveform data memory into an analog signal and outputting the analog signal;

a power amplifier for amplifying a voltage and a current of the analog signal, and outputting the driving voltage signal;

a gradation data separation/accumulation circuit for separating printing gradation data contained in printing data, accumulating digital data representing the separated printing gradation data temporarily, and outputting the separated printing gradation data at a predetermined timing;

a data comparator circuit for comparing the voltage level of the printing gradation data with that of the driving waveform data and outputting a comparison signal;

a printing control circuit for outputting a switch control signal upon judgment of presence of an ink discharge instruction signal contained in the printing data;

a switch control circuit for making a logical product by the comparison signal and the switch control signal, thereby outputting an analog switch control signal; and a bidirectional analog switch for controlling conductivity of the driving voltage signal outputted from the power amplifier in accordance with the analog switch control signal, so as to apply the driving voltage signal to the piezoelectric actuator.

10. A circuit for driving an ink-jet head according to claim 9, wherein the memory control circuit, the driving waveform data memory, the digital/analog converter circuit, the power amplifier, the gradation data separation/accumulation circuit, and the printing control circuit are common to all piezoelectric actuators provided in the ink-jet head;

the data comparator circuit, the switch control circuit, and the bidirectional analog switch are provided individually to every piezoelectric actuator provided in the ink-jet head, and the power amplifier and the bidirectional analog switch are supplied with a power source voltage for driving the piezoelectric actuator, and circuits other than those are supplied with a standard logic voltage.

11. A circuit for driving an ink-jet head comprising:

a driving waveform data memory for accumulating digital data converted from driving waveform data obtained by dividing a driving voltage signal for driving a piezoelectric actuator of the ink-jet head by a time unit;

a memory control circuit for sequentially outputting address data in the driving waveform data memory at a predetermined time interval;

a digital/analog converter circuit for converting the driving waveform data outputted from the driving waveform data memory into an analog signal having a level capable of directly driving the piezoelectric actuator;

a current amplifier for amplifying a current of the analog signal, thereby outputting the driving voltage signal;

a gradation data separation/accumulation circuit for separating printing gradation data contained in printing data, accumulating digital data representing the separated printing gradation data temporarily, and outputting the separated printing gradation data at a predetermined timing;

a data comparator circuit for comparing a voltage level of the printing gradation data with that of the driving waveform data and outputting a comparison signal;

a printing control circuit for outputting a switch control signal upon judgment of presence of an ink discharge instruction signal contained in the printing data;

a switch control circuit for making a logical product by the comparison signal and the switch control signal, thereby outputting an analog switch control signal; and a bidirectional analog switch for controlling conductivity of the driving voltage signal outputted from the current amplifier in accordance with the analog switch control signal, so as to apply the driving voltage signal to the piezoelectric actuator.

12. A circuit for driving an ink-jet head according to claim 11, wherein the memory control circuit, the driving waveform data memory, the digital/analog converter circuit, the current amplifier, the gradation data separation/accumulation circuit, and the printing control circuit are common to all of the piezoelectric actuator provided in the ink-jet head, the data comparator circuit, the switch control circuit, and the bidirectional analog switch are provided individually to every piezoelectric actuator provided in the ink-jet head, and the digital/analog converter circuit, the current amplifier, and the bidirectional analog switch are supplied with a power source voltage for driving the piezoelectric actuator, and the respective circuits other than those are supplied with a standard logic voltage.

13. A method of driving an ink-jet head comprising the steps of:

outputting driving waveform data from a driving waveform data memory synchronized with address data, said driving waveform data being digital data corresponding to a driving voltage signal for driving a piezoelectric actuator of the ink-jet head;

converting the driving waveform data into an analog signal;

outputting the driving voltage signal while amplifying a voltage and a current of the analog signal;

separating printing gradation data contained in printing data, accumulating the separated printing gradation data temporarily as digital data, and outputting the separated printing gradation data at a predetermined timing;

comparing a voltage level of the printing gradation data with the that of the driving waveform data, thereby outputting a comparison signal;

outputting a switch control signal upon judgment of presence of an ink discharge instruction signal contained in the printing data;

making a logical product by the comparison signal and the switch control signal, thereby outputting an analog switch control signal; and controlling a bidirectional analog switch in accordance with the analog switch control signal, thereby controlling conductivity of the driving voltage signal so as to supply the driving voltage signal to the piezoelectric actuator.

14. A method of driving an ink-jet head comprising the steps of:

outputting driving waveform data from a driving waveform data memory syncronized with address data, said driving waveform data being digital data corresponding to a driving voltage signal for driving a piezoelectric actuator of the ink-jet head;

converting the driving waveform data into an analog signal having a level capable of directly driving the piezoelectric actuator;

outputting the driving voltage signal while amplifying a current of the analog signal;

separating printing gradation data contained in printing data, accumulating the separated printing gradation data temporarily as digital data, and outputting the separated printing gradation data at a predetermined timing;

comparing a voltage level of the printing gradation data with the that of the driving waveform data, thereby outputting a comparison signal;

outputting a switch control signal upon judgment of presence of an ink discharge instruction signal contained in the prining data;

making a logical product by the comparison signal and the switch control signal, thereby outputting an analog switch control signal; and controlling a bidirectional analog switch in accordance with the analog switch control signal, thereby controlling conductivity of the driving voltage signal so as to supply the driving voltage signal to the piezoelectric actuator.

15. A method of driving an ink-jet head according to claim 13, further comprising the steps of:

outputting driving waveform data from the driving waveform data memory, said driving waveform data obtained by converting the driving voltage signal into digital data, said driving voltage signal comprising an initial voltage waveform generated during an initial period for initializing an ink chamber of the ink-jet head, a first ink supply voltage waveform which rapidly changes with respect to time, said time occurring during a first ink supply period for rapidly supplying ink to the ink chamber, a second ink supply voltage waveform which gently changes with respect to time said time occurring during a second ink supply period for slowly supplying ink to the ink chamber, an ink discharge voltage waveform which rapidly changes with respect to time in an opposite direction to the first and second ink supply voltages, said time occurring during an ink discharge period for rapidly discharging the ink from the ink chamber, and a restoring voltage waveform which is generated during a restoring period for restoring the ink chamber to its initial state;

comparing the driving waveform data with the printing gradation data, reversing the comparison signal at a point where the driving waveform data first crosses the printing gradation data, and then reversing the comparison signal again at the point where the driving waveform data crosses the printing gradation data; and permitting a bidirectional analog switch to be conductive except in a period during which the comparison signal is first reversed, thereby supplying the driving voltage signal to the piezoelectric actuator, thereby adjusting ink droplet discharged from the ink-jet head in accordance with the printing gradation data.

16. A method of driving an inkjet head according to claim 14, further comprising te steps of:

outputting driving waveform data from the driving waveform data memory, said driving waveform data obtained by converting the driving voltage signal into digital data, said driving voltage signal comprising an initial voltage waveform generated during an initial period for initializing an ink chamber of the ink-jet head, a first ink supply voltage waveform which rapidly changes with respect to time, said time occurring during a first ink supply period for rapidly supplying ink to the ink chamber, a second ink supply voltage waveform which gently changes with respect to time, said time occurring during a second ink supply period for slowly supplying ink to the ink chamber, an ink discharge voltage waveform which rapidly changes with respect to time in an opposite direction to the first and second ink supply voltages, said time occurring during an ink discharge period for rapidly discharging the ink from the ink chamber, and a restoring voltage waveform which is generated during a restoring period for restoring the ink chamber to its initial state;

comparing the driving waveform data with the printing gradation data, reversing the comparison signal at a point where the driving waveform data first crosses the printing gradation data, and then reversing the comparison signal again at the point where the driving waveform data crosses the printing gradation data; and permitting a bidirectional analog switch to be conductive except in a period during which the comparison signal is first reversed, thereby supplying the driving voltage signal to the piezoelectric actuator, thereby adjusting ink droplet discharged from the ink-jet head in accordance with the printing gradation data.

* * * * *